US006028562A

United States Patent [19]

Guler et al.

[11] Patent Number: 6,028,562

[45] Date of Patent: Feb. 22, 2000

[54] DUAL POLARIZED SLOTTED ARRAY ANTENNA

[75] Inventors: Michael G. Guler, Lilburn; James P. Montgomery, Roswell, both of Ga.

[73] Assignee: EMS Technologies, Inc., Norcross, Ga.

[21] Appl. No.: 08/903,678

[22] Filed: Jul. 31, 1997

[51] Int. Cl.[7] ..... H01Q 13/10

[52] U.S. Cl. ..... 343/771; 343/770

[58] Field of Search ..... 343/771, 767, 343/770, 768, 789, 700 MS; H01Q 13/10

[56] References Cited

U.S. PATENT DOCUMENTS

| | | | |
|---|---|---|---|
| 3,503,073 | 3/1970 | Ajioka | 343/771 |
| 4,673,946 | 6/1987 | Hoover | 343/776 |
| 4,792,809 | 12/1988 | Gilbert et al. | 343/770 |
| 4,985,708 | 1/1991 | Kelly | 343/771 |
| 5,030,965 | 7/1991 | Park et al. | 343/770 |
| 5,406,292 | 4/1995 | Schnetzer et al. | 343/700 |
| 5,473,334 | 12/1995 | Yee et al. | 343/756 |
| 5,543,810 | 8/1996 | Park | 343/771 |
| 5,581,266 | 12/1996 | Peng et al. | 343/770 |
| 5,596,336 | 1/1997 | Liu | 343/770 |
| 5,619,216 | 4/1997 | Park | 343/771 |
| 5,661,493 | 8/1997 | Uher et al. | 343/700 MS |

FOREIGN PATENT DOCUMENTS

WO97/22159 6/1997 WIPO .

OTHER PUBLICATIONS

"Arbitrarily Polarized Slot Radiators in Bifurcated Waveguide Arrays", by James S. Ajioka, Dick M. Joe, Raymond Tang, and Nam San Wong, IEEE Transactions of Antennas and Propagation, vol. AP–22, No. 2, Mar., 1974, pp. 196–200.

"Dual Polarised Slooted Waveguide SAR Antenna", by Lars Josefsson and C.G.M. van't Klooster, IEEE Antennas and Propagation Society International Symposium, vol. 1, Jul. 18–25, 1992, pp. 625–628.

"Polarisation Diversity Techniques for Slotted–Wavegujide Array Antennas", by A.J. Sangster, Mikrowellen & HF Magazine, vol. 15, No. 3, 1980, pp. 237–243.

"A Dual Polarised Slotted Waveguide Array Antenna", by L. Josefsson, Proceedings of the 1992 URSI International Symposium on Electromagnetic Theory, Aug. 17–20, 1992.

"Concept of an X–Band Synthetic Aperture Radar for Earth Observing Satellites", by W. Jatsch and E. Langer, Journal of Electromagnetic Waves and Applications, vol. 4, No. 4, 1990, pp. 325–340.

"Slot Array Antenna System for COMETS", by Yoshihiro Hase, Noriaki Obara, Haruo Saitoh, and Chiharu Ohuchi, 1996 IEEE 46th Vehicular Technology Conference, May 1996, pp. 353–356.

"A Two–Beam Slotted Leaky Waveguide Array for Mobile Reception of Dual Polarization DBS", by J. Hirokawa et al., IEEE Antennas and Propagation Society International Symposium, vol. 1, Jul. 21–26, 1996, pp. 74–77.

*Primary Examiner*—Hoanganh Le
*Attorney, Agent, or Firm*—Jones & Askew, LLP

[57] ABSTRACT

A waveguide-implemented antenna comprising a planar array of waveguide slot radiators for communicating electromagnetic signals exhibiting simultaneous dual polarization states. The antenna can consist of parallel waveguides of rectangular or ridged cross section. The broadwalls of each parallel waveguide contain a linear array of input slots for receiving (transmitting) electromagnetic signals having a first polarization state from (to) the parallel waveguide and for transmitting (receiving) those signals into (from) an array of cavity sections. The cavity sections comprise a short section of uniform waveguide with a length of much less than a wavelength in the propagation direction. The cavity sections feed to output slots which are rotated relative to the input slots; such that the output slots exhibit a second polarization state, which they radiate (receive) to (from) free space. By interlacing parallel waveguides with alternating +45 degree and −45 degree rotations of the output slots, two independent antennas are formed exhibiting simultaneous dual polarizations.

49 Claims, 13 Drawing Sheets

16
60

60

64
16

64

16

62

DUAL POLARIZED SLOTTED ARRAY ANTENNA

FIELD OF THE INVENTION

The invention is generally directed to a slotted array antenna for communicating electromagnetic signals and, more particularly described, is a waveguide-implemented planar array antenna using improved waveguide slot radiators to communicate electromagnetic signals with simultaneous dual polarization states.

BACKGROUND OF THE INVENTION

Slotted array antennas often use a waveguide distribution network for distributing RF energy to and from an array of slots placed along the broad wall of a waveguide channel. These waveguide-implemented antennas can be used for communication applications requiring low profile and space-limited mountings, such as aircraft installations. The design of a low profile, space-limited slotted array antenna, however, can be a challenging objective for satellite communication applications, which typically rely upon the transmission and reception of information with two different characteristic polarization states.

A pair of separate spaced-apart antennas, each having a corresponding polarization state, can be used to receive information from a source transmitting information with two different characteristic polarization states. This use of a pair of different antennas, however, often fails to satisfy the need to conserve physical installation space for a space-limited application. Alternatively, a single aperture antenna can be used to receive multiple-polarization information based on the concept of polarization diversity. For example, a dual polarization communications design can be used to reduce an antenna system from two physically separated antennas to a single aperture antenna having two characteristic polarization states.

A prior solution for communicating information with dual characteristic polarization states is an interlaced combination of a pair of slot antennas, a first antenna having slots along the broad wall of a waveguide channel and a second antenna having slots along the narrow wall of a waveguide channel. The slots of the first antenna are associated with a characteristic polarization state, and the slots of the second antenna are associated with another characteristic polarization state. Although the interleaving of separate slot antennas can support the communication of dual polarized information, this antenna design also results in the use of complex end-feed networks and interlaced antennas having different frequency responses. In addition, this stacking of broad and narrow wall waveguide channels in an interleaved manner can be difficult to manufacture for high volume applications. In other words, the interleaving of a pair of broad/narrow wall waveguide antennas to achieve the communication of dual polarized information generally results in increased design activity and a complex manufacturing process.

Another prior dual polarized antenna comprises dual polarized slot radiators in bifurcated waveguide arrays. The radiating element consists of a pair of crossed slots in the sidewall of a bifurcated rectangular waveguide that couples even and odd waveguide modes. One linear polarization is excited by the even mode, and the orthogonal linear polarization is excited by the odd mode. This antenna design approach suffers from the disadvantage of requiring an end-feed network rather than the preferred center or rear-feed network of typical slotted array antennas. In addition, manufacturing the antenna is a relatively complex operation because of the requirement of cutting or stamping out the crossed-slot radiating elements within the wall of the bifurcated rectangular waveguide.

Yet another prior antenna design relies upon a small circular hole or an X-slot located in the broadwall of a rectangular waveguide, approximately half-way between the center line and the narrow wall. A right-hand circular polarization can be achieved by feeding the waveguide from one end. In contrast, a left-hand circular polarization can be achieved by feeding the waveguide from the opposite end. This design suffers from the disadvantage of requiring two separate end-feed networks, rather than the preferred center or rear-feed network of typical slotted array antennas.

Thus, there exists a need for a dual polarized slotted array antenna capable of supporting simultaneous dual polarization states and using a convenient center or rear-feed network. There is also a need for a dual polarized waveguide-implemented antenna employing a planar array of slots, which can be efficiently and readily manufactured using conventional manufacturing techniques. There is also a need for an improved waveguide slot radiator to support the reduction of the profile of a single aperture slotted array antenna capable of supporting simultaneous dual polarization states.

SUMMARY OF THE INVENTION

The present invention provides significant advantages over the prior art by providing an electromagnetic communication system for achieving simultaneous dual polarization electromagnetic signals within a single antenna aperture. This objective is accomplished by the use of a waveguide slot radiator formed by a relatively thin cavity section placed between an input slot and an output slot. Polarization diversity can be achieved by rotating the position of the output slot relative to the position of the input slot.

The present invention comprises a slot (the "input slot") that feeds a cavity section which, in turn, feeds a rotated radiating slot (the "output slot"). The input slot can receive electromagnetic signals having a first polarization state from the waveguide and passes these signals to the cavity section. The cavity section includes a first opening positioned adjacent to the input slot and a second opening positioned adjacent to the output slot. The cavity section is operative to rotate the electromagnetic field from the first polarization state to the second polarization state and to provide an impedance match for efficient transmission of the signal from the input slot to the output slot. The output slot responds to the electromagnetic signals having the second polarization state and radiates these electromagnetic signals into free space.

For a waveguide-implemented slotted array antenna, a typical broad wall, shunt slot radiator provides linear polarization perpendicular to the axis of the waveguide. The input slot can be implemented as a shunt slot, typically located on the broadwall of the waveguide, for directing electromagnetic signals having the first polarization state into the cavity section. These electromagnetic signals are typically distributed to the input slot via a waveguide assembly which, in turn, can be fed by a rear-feed distribution network. The output slot comprises a slot rotated relative to the position of the input slot and responsive to electromagnetic signals having the second polarization state. The field rotation can take place in a-cavity section which is much less than one wavelength thick. Consequently, the additional cavity section and the output slot have little effect on the overall array thickness or weight of a slotted array antenna employing this waveguide slot radiator design. For example, both the cavity section and the output slot can be machined into a single sheet of aluminum, adding only a single thin layer to a standard waveguide slot array antenna.

Different configurations of the slots and the cavity section can be used to achieve the desired impedance match between the input slot and the output slot. For example, connecting the input slot to a rotated output slot via a rectangular-shaped cavity section can present a relatively poor impedance match due to the large physical discontinuities formed at the interfaces. To match the impedances presented at this junction, the discontinuities are reduced as much as possible, and an offsetting susceptance is then introduced to cancel the undesired susceptance produced by the remaining discontinuities. This can be accomplished by constricting the central portion of the broad walls of the cavity section.

An alternate method of matching the input slot to output slot is to form a TEM mode structure in the cavity section. The transition from input slot to output slot then can be viewed as a transition from TE mode-to-TEM mode-to-TE mode. For example, the cavity can be implemented as a coaxial-like TEM structure or a twin-lead TEM structure for this type of waveguide slot radiator.

Once a desired match of the slot transition is accomplished, the resulting structure formed by the input slot, cavity section, and output slot can be optimized for use with a waveguide-implemented antenna. Typically, this structure is optimized for connection into the broad wall of a rectangular waveguide or a ridge waveguide. Various design parameters, such as length, width and thickness of the input slot, output slot and cavity section, can be varied to achieve the proper resonant frequency. The position of the input slots, typically offset from the centerline of the waveguide broad wall, can be adjusted to achieve the proper excitation of the input slots. Alternatively, the input slots can be aligned with the centerline of the waveguide broad wall, and asymmetries within the waveguide can control the slots excitation.

A waveguide-implemented single aperture antenna can be constructed using a planar array of waveguide slot radiators. The antenna includes multiple waveguide assemblies, each having a waveguide channel formed by a rear wall and a pair of spaced-apart side walls connected to each side of the rear wall. A rectangular ridge can run along the inside of the rear wall to allow a reduction in the physical width of the waveguide channel. A slotted plate is positioned adjacent to the open faces of the waveguide channels, thereby forming enclosed waveguide channels, i.e., waveguides. The slotted plate comprises a planar array of input slots for receiving electromagnetic signals having a first polarization state from each waveguide channel. Another plate, commonly described as a radiator plate, is positioned adjacent to the face of the slotted plate and includes an array of slots comprising a combination of cavity sections and output slots. The cavity sections have a one-to-one relationship with the output slots, and are typically positioned along the rear surface of the radiator plate. In contrast, the output slots are typically placed on the face of the radiator plate and are coupled to the cavity sections. By aligning the slotted plate with the radiator plate, an array of waveguide slot radiators is created, each comprising aligned combinations of an input slot, a cavity section, and an output slot.

Each cavity section of the radiator plate is associated with one of the output slots and comprises a first opening and a second opening. The first opening is positioned adjacent to one of the input slots to allow the cavity section to accept the electromagnetic signals having the first polarization state from the input slot. The second opening is positioned adjacent to one of the output slots to allow the cavity section to pass the electromagnetic signals having the second polarization state to the output slot. The cavity section can be viewed as a transitional section of transmission line, located between the input slot and the output slot, for rotating the polarization of electromagnetic signals from the first polarization state to the second polarization state, and for passing the electromagnetic signals efficiently from the input slot to the output slot. Each output slot receives electromagnetic signals having the second polarization state from the cavity section, and responds by radiating electromagnetic signals of the second polarization state to free space. To achieve a change in the polarization of the electromagnetic signals, the output slots are typically rotated in position relative to the input slots.

Bandwidth improvement for the antenna can be achieved by improving the impedance match of the waveguide slot radiators, as viewed from the free space side of the radiators. This improved match can be accomplished by the addition of a relatively thin layer of high dielectric constant material, which is spaced off of the output slots by a relatively thin layer of low dielectric constant material.

For one aspect of the present invention, a 45° slant left polarization slot array can be interlaced with a 45° slant right polarization slot array within a common antenna aperture to provide the capability of transmitting and receiving simultaneous dual orthogonal linear polarization states. This can be accomplished by alternating the placement of side-by-side waveguide assemblies, the first waveguide assembly comprising waveguide slot radiators for communicating electromagnetic signals of a selected polarization state (e.g., 45° slant left) and the second waveguide assembly comprising waveguide slot radiators for communicating electromagnetic signals of another selected polarization state (e.g., 45° slant right). With the addition of a single meanderline polarizer placed along the face of the waveguide slot radiators, this exemplary antenna can support the communication of simultaneous left hand circular and right hand circular polarization states. Consequently, the present invention can support the implementation of a slotted array antenna comprising interlaced slotted arrays within a common antenna aperture for communicating signals having simultaneous dual orthogonal polarization states. The signals exhibiting dual orthogonal polarization states can have the same frequency range or different frequency bands.

For another aspect of the present invention, a slotted array antenna can be formed by interlacing a slotted array exhibiting a first polarization state with a slotted array exhibiting a second polarization state within a common antenna aperture to support the communication of electromagnetic signals having a pair of arbitrary polarization states. This can be accomplished by alternating the placement of side-by-side waveguide assemblies, the first waveguide assembly comprising waveguide slot radiators for communicating electromagnetic signals of the first arbitrary linear polarization state and the second waveguide assembly comprising waveguide slot radiators for communicating electromagnetic signals of the second arbitrary linear polarization state. The pair of arbitrary linear polarization states can be associated with the same frequency band or with different frequency bands.

For a further aspect of the present invention, a slotted array antenna can be implemented as a single slotted array for supporting the communication of electromagnetic signals exhibiting a signal polarization state. In contrast to the interlaced array designs discussed above, this antenna design is characterized by a non-interlaced array of waveguide slot radiators, each comprising an input slot, a transitional cavity section, and an output slot. The transitional cavity section can rotate the polarization state of electromagnetic signals passing between the input slot and the output slot. This slotted array antenna is useful for both receiving and transmitting electromagnetic signals having a single polarization state.

In view of the foregoing, these and other advantages of the present invention will become apparent from the detailed description and drawings to follow and the appended claim set.

DETAILED DESCRIPTION OF EXEMPLARY EMBODIMENTS

Figure 1:
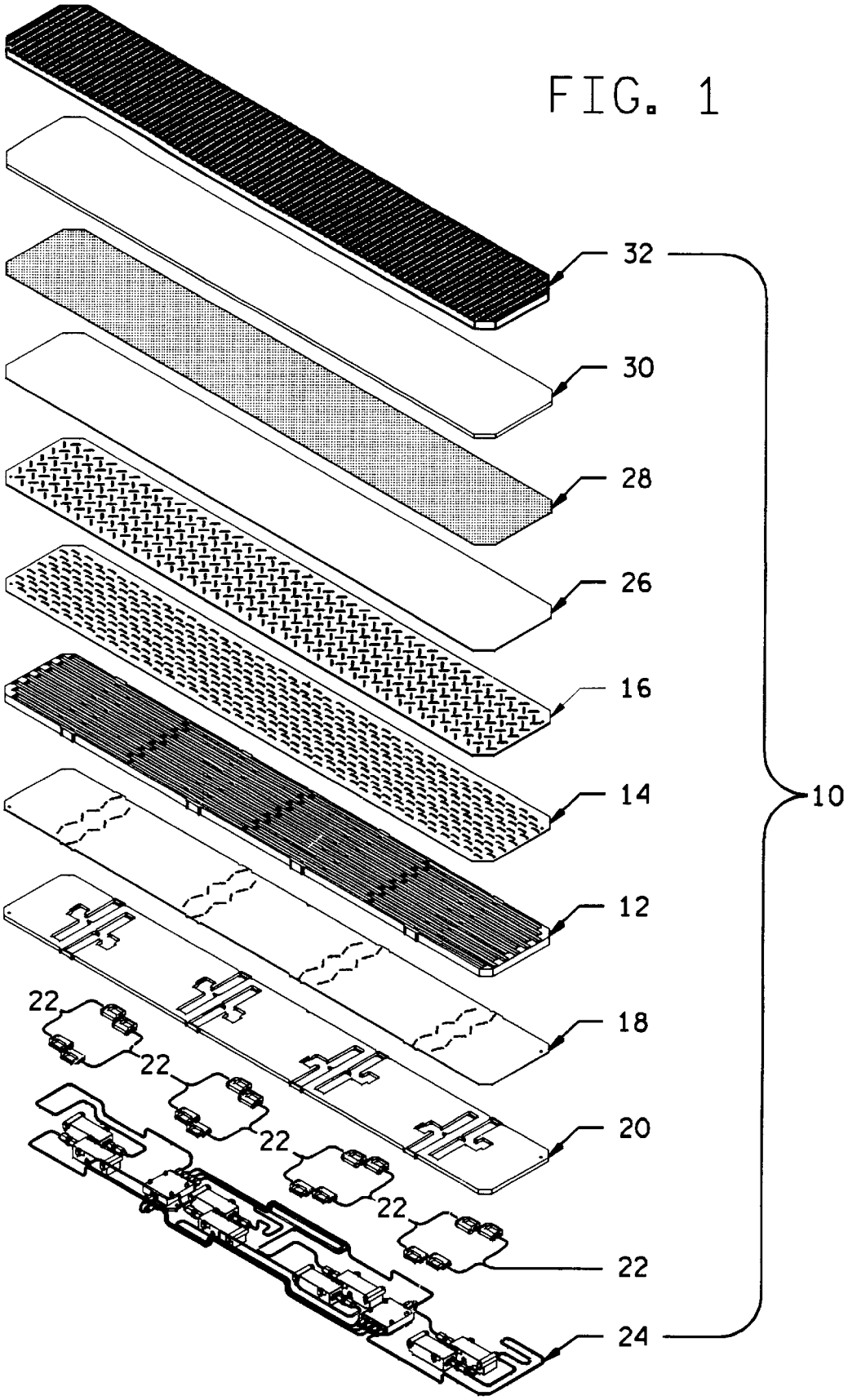
FIG. 1 is an exploded view showing the assembly of an antenna in accordance with an exemplary embodiment of the present invention.

The present invention provides a waveguide-implemented antenna including a planar array of improved waveguide slot radiators for communicating electromagnetic signals exhibiting simultaneous dual polarization states. The antenna can be implemented as a single aperture antenna by interleaving alternate waveguide assemblies, each supporting one of a pair of orthogonal polarization states. For example, an array of waveguide assemblies having 45° slant left waveguide slot radiators can be interlaced with an array of waveguide assemblies having 45° slant right waveguide slot radiators within a common antenna aperture to support the transmission and reception of simultaneous dual orthogonal linear polarization states. Each waveguide slot radiator is implemented by a transitional cavity section positioned between an input slot and an output slot. The output slot can be rotated in position relative to the input slot to change the polarization of electromagnetic signals passed between these slots. Thus, the present invention can support the simultaneous communication of orthogonal polarization signals using a single aperture antenna structure.

An exemplary embodiment of the present invention uses a pair of interlaced slotted antenna arrays to form a single aperture antenna capable of simultaneous communication of dual polarization signals. In essence, two different antennas, each supporting the communication of a different polarization state, are interlaced to form a single aperture antenna. The interlaced arrays can operate at the same frequency or, alternatively, each array can operate at different frequencies to support communication applications requiring different receive/transmit frequencies. This single aperture antenna implementation is based on a resonant or traveling wave slot array design supporting rear or center-feed distribution networks for the waveguide-implemented antenna. In this manner, a low-profile antenna can be constructed for use in applications having space limitations and requiring the reception and/or transmission of dual polarization signals. Alternate embodiments can support the communication of signals exhibiting linear or circular polarization states.

Generally described, this single aperture antenna design comprises waveguide assemblies or structures formed by the combination of a waveguide channel plate and a slotted plate. The waveguide channel plate preferably comprises inverted-U-shaped waveguide channels and feed ports. Each waveguide channel includes a rear wall and a pair of parallel, spaced-apart side walls connecting the sides of the rear wall. A rectangular ridge runs along the inside of the rear wall to allow a reduction in the physical width of the waveguide channel. The slotted plate is typically positioned parallel to the face of the rear wall of the waveguide channel and perpendicular to the side walls to form an enclosed waveguide channel, i.e., a waveguide. Those skilled in the art will appreciate that the waveguides formed by the combination of the waveguide channel plate with the slotted plate forms a parallel set of ridged waveguides. The slotted plate comprises a planar array of input slots, typically constructed as shunt slots extending along the propagation axis of the enclosed waveguide channel. The input slots, typically having a rectangular shape, are cut within the slotted plate and can receive electromagnetic signals having a first polarization state from the waveguide channels. Advantageously, the waveguide assemblies can be fed by a waveguide-implemented distribution network mounted to the rear of the antenna. This type of feed distribution network can pass signals to and from feed ports positioned along each waveguide channel of the waveguide channel plate.

The combination of the waveguide channel plate with the slotted plate forms waveguide structures including input slots cut within either a broad wall or a narrow wall of the waveguide structure. Although the input slots are preferably placed along a broad wall of each waveguide structure, it will be appreciated that "edge wall"-type slots also can be placed along a narrow wall of a waveguide structure. The waveguide structure is not limited to a particular type of waveguide configuration, but is preferably implemented as either ridge waveguide or rectangular waveguide.

A radiator plate, typically positioned adjacent to the face of the slotted plate, includes a planar array of cavity sections and output slots. The cavity sections are positioned along the rear surface of the radiator plate, whereas the output slots are cut within the face of this plate. Each cavity section is associated with an output slot and comprises a first opening and a second opening. The first opening is positioned adjacent to an input slot and the second opening is located adjacent to the corresponding output slot. Each cavity section receives electromagnetic signals of the first polarization state from the input slots and rotates the polarization to the second state. Each output slot receives electromagnetic signals of the second polarization state from the cavity sections and radiates these signals into free space. To achieve this change in polarization states, the output slots are typically rotated in position with respect to the input slots, with the cavity section operating as a transitional transmission line section between the input and output slots. In view of the foregoing, it will be appreciated that an array of waveguide slot radiators is created by combining the slotted plate with the radiator plate.

Prior to discussing the embodiments of the antenna provided by the present invention, it will be useful to review the salient features of an antenna formed by a planar array of waveguide slot radiators. An attractive feature of the slot as a radiating element in an antenna system is that an array of slots may be integrated into a feed distribution system without requiring any special matching network. For example, an energy distribution network, typically formed in a waveguide or stripline transmission medium, typically provides energy to each radiating element. Low-profile, high-gain antennas can be configured using slot radiators, although such antennas are generally bandwidth-limited by input VSWR performance.

A slot cut into the wall of a waveguide interrupts waveguide wall current flow and will couple energy from the waveguide into free space. Waveguide slots may be characterized by their shape and location on the wall of the waveguide and by their equivalent electrical circuits. A slot cut into the broad wall of a waveguide and located an odd multiple of quarter guide wavelengths from the waveguide end may be represented equivalently by a two terminal shunt admittance. These slots are typically oriented parallel to the direction of propagation and interrupt only transverse currents. These slots are commonly known as shunt slots. By comparison, a slot cut into the broad wall of a waveguide and located an even multiple of quarter guide wavelengths from the waveguide end may be represented by a series impedance. These slots are typically centered in the broadwall at an angle between zero and ninety degrees relative to the propagation direction. These slots are commonly known as series slots. Equivalent circuit admittance and impedance values for particular shunt and series slots may be determined with the aid of measured data and design equations that are well known to those persons skilled in the art.

After individual slot element characteristics have been determined, the designer of a linear resonant slot array must specify shunt slot locations and resonant conductances. This supports the design for an antenna impedance match and determines the aperture distribution. Slot spacing is limited by the appearance of grating lobes as slot spacings increase toward one free-space wavelength and by the requirement that all slots be illuminated in-phase. To meet both requirements simultaneously, slots are typically spaced at one-half of the guide wavelength along the waveguide centerline and on alternating sides of the centerline. The waveguide size is chosen such that the guide wavelength is typically between 1.4 and 1.6 free space wavelengths. An array of shunt slots in the broad waveguide wall spaced in this manner will produce radiation polarized perpendicularly to the array axis.

The basic building block of a linear resonant slot array is a single waveguide section fed from either end or the rear of the waveguide. The number of slots in the waveguide is practically limited by input VSWR bandwidth and by array pattern requirements. Basic design requirements include: (1) the sum of all normalized slot resonant conductances are nominally made to be equal to 2 for a center feed (or 1 for an end feed), and (2) the radiated power from each slot location is proportional to that slot's resonant conductance. The sum of all normalized slot resonant conductances may purposely be made different from the matched condition to achieve a greater usable bandwidth or the feed network may have impedance transformation characteristics that can accomplish the matching. In the preferred embodiment of the antenna described below, the slots are designed to radiate equal power, so the resonant conductance of all slots is designed to be equal.

Turning now to the drawings, in which like reference numbers refer to like elements, FIG. 1 is a diagram illustrating an exploded view of the primary components of an exemplary embodiment of the present invention. FIGS. 2A–2G, 3A–3C, 4A–4F, 5A–5B, and 6A–6C show various views of the components presented in FIG. 1, specifically a waveguide channel plate, a slotted plate, a radiator plate, a series slot plate, and a signal distribution plate. Referring generally to FIG. 1, the antenna 10 is particularly useful for wireless communications systems requiring a low profile antenna for limited space applications. This slotted array implementation of the antenna 10 supports low profile applications based on its relatively flat plate appearance and rear-fed distribution network. The antenna 10 is preferably implemented as a single aperture antenna employing a parallel set of interleaved planar arrays of waveguide slot radiators, each set of slotted arrays supporting one of a pair of polarization states.

An exemplary embodiment of the antenna 10 can be created by the combination of a set of conductive plates, each associated with a particular antenna function. In particular, a waveguide-implemented antenna can be created by the combination of a slotted plate 14 positioned between a waveguide channel plate 12 and a radiator plate 16. The combination of the waveguide channel plate 12 and the slotted plate 14 creates a set of parallel waveguide assemblies, each waveguide having input slots within the top wall and feed ports within the rear wall. The input slots, typically rectangular-shaped slots cut within the slotted plate 14, represent shunt-type slots for a conventional slotted array antenna. The radiator plate 16 comprises a planar array of output slots along the face of the plate and cavity sections extending along the rear plate surface, the cavity sections having a one-to-one correspondence with the output slots. The combination of the slotted plate 14 and the radiator plate 16 creates a planar array of waveguide slot radiators, each radiator comprising a relatively thin cavity section positioned between an input slot and an output slot. The cavity section has a thickness range of between 0.03 and 0.2 wavelengths, preferably less than 0.1 wavelengths. A waveguide-implemented feed distribution network, located at the rear of the antenna, passes signals to and from the feed ports of the waveguide channel plate 12. The feed distribution network, created by the combination of a series slot plate 18, a signal distribution plate 20 and short circuit elements 22, is mounted to the rear surface of the waveguide plate 12. A subarray combining circuit 24 can be mounted to the signal distribution network plate 20 to combine the four subarrays of each orthogonal polarization into a single input port for each polarization.

To improve the bandwidth characteristics of the antenna 10, a layer of high dielectric constant material 28 is separated from the face of the radiator plate 16 by a layer of low dielectric constant material 26. To vary the polarization characteristic of signals received or transmitted by the antenna 10, a polarizer 32 is separated from the layer of the high dielectric constant material 28 by a layer of low dielectric constant material 30. It will be appreciated that the dielectric materials 26 and 28, as well as the dielectric material 30 and the polarizer 32, represent optional features to improve the relative performance of the antenna 10.

Figures 2A, 2B, 2C, 2D, 2E:
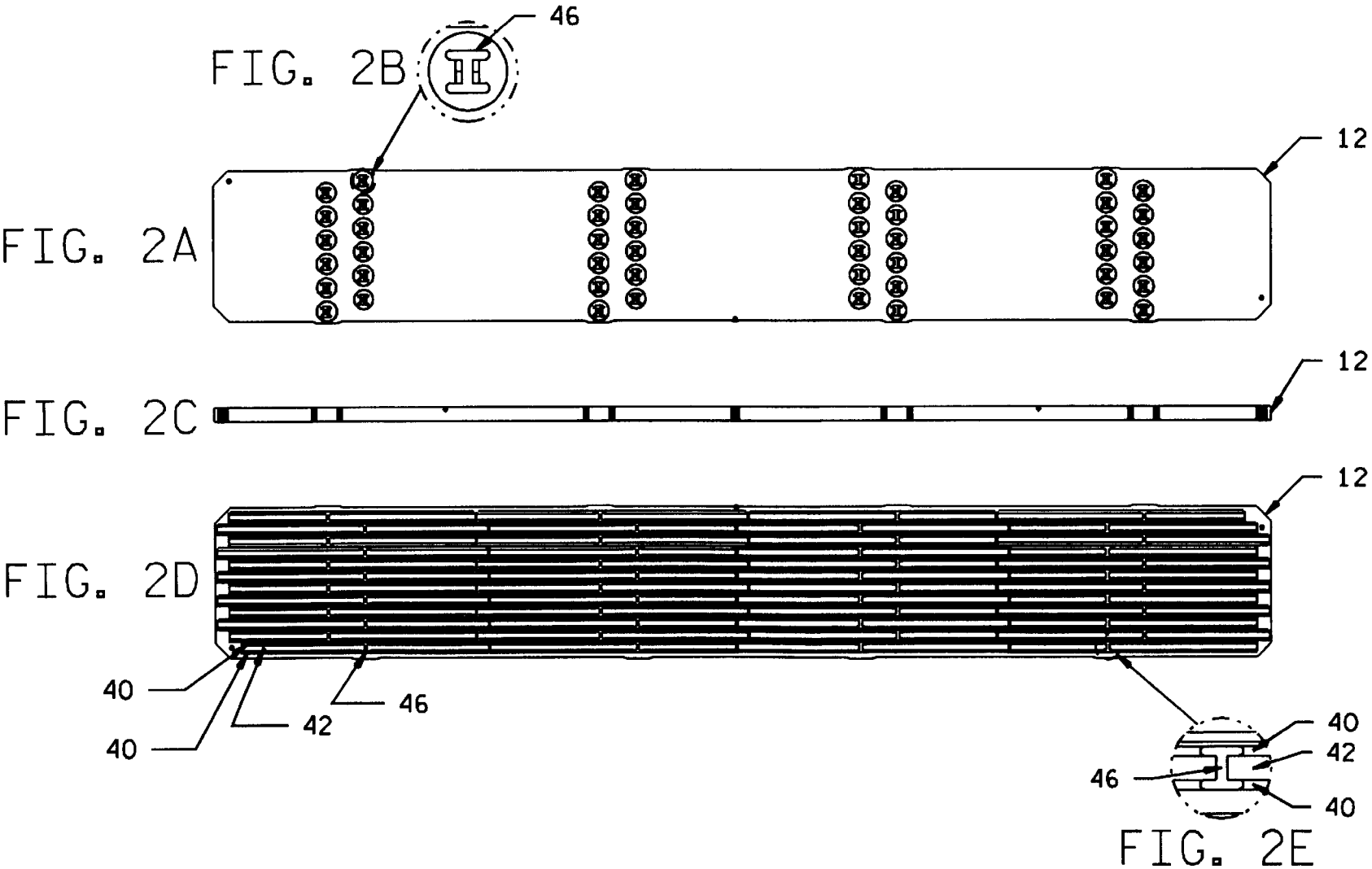
FIG. 2A is an illustration showing a rear view of a waveguide channel plate in accordance with an exemplary embodiment of the present invention.
FIG. 2B is an enlarged view of a feed port along the rear surface of the plate presented in FIG. 2A.
FIG. 2C is an illustration showing a side view of the plate presented in FIG. 2A.
FIG. 2D is an illustration showing a front view of the plate presented in FIG. 2A.
FIG. 2E is an enlarged view of a waveguide channel and a feed port along the front surface of the plate presented in FIG. 2D.
Figure 2F:
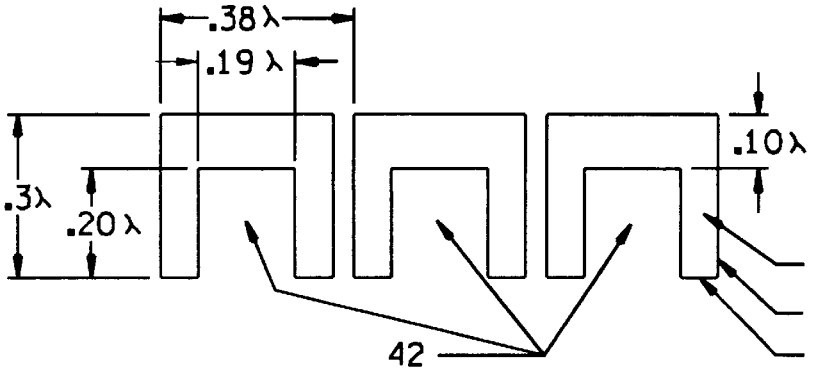
FIG. 2F is an illustration showing ridge sections for a portion of the waveguide channels on the plate presented in FIG. 2A, as viewed from one end of the plate.
Figure 2G:
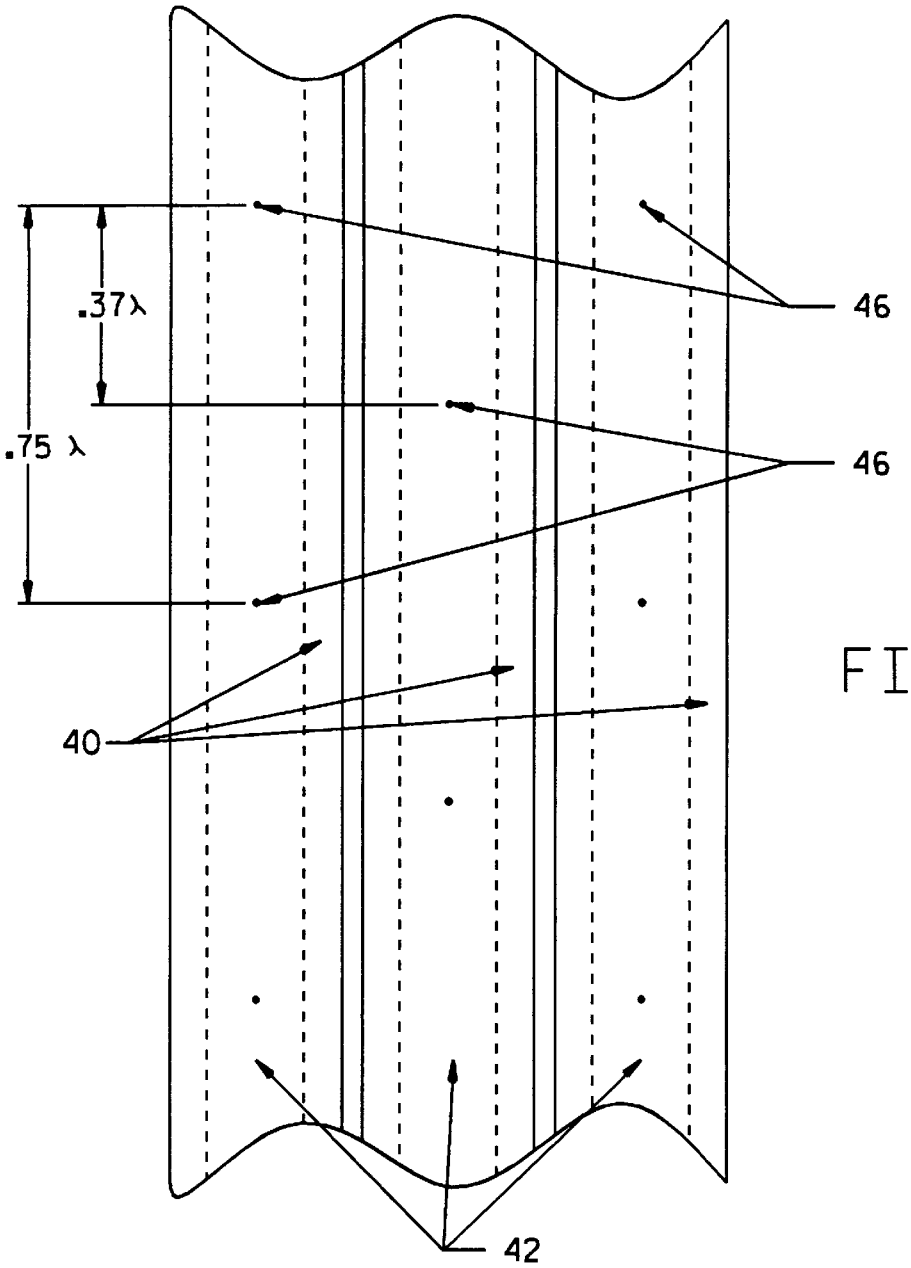
FIG. 2G is an illustration showing a front view of a portion of the plate presented in FIG. 2A, and illustrates the approximate location of feed ports positioned along the plate.

As shown in FIGS. 2A–2G, collectively described as FIG. 2, the waveguide channel plate 12 comprises parallel waveguide channels 40 located on the face of the plate. Because the antenna 10 is preferably constructed as an interleaved pair of slotted arrays, adjacent waveguide channels 40 are associated with different slotted arrays having selected polarization characteristics. In other words, every other waveguide channel 40 supports the communication of electromagnetic signals having the same polarization characteristic. Each waveguide channel 40 preferably comprises a rear wall 41 with an internal rectangular ridge 42 connected by parallel, spaced-apart side walls 44 to form an inverted-U-shaped channel. Waveguide feed ports 46 are positioned along each rear wall 41 and between the corresponding side walls 44. A rear expanded view of a representative feed port, which includes an H-shaped signal port, is presented in FIG. 2B. A front expanded view of this representative feed port, which is positioned along a rear wall and between a pair of spaced-apart, parallel side walls, is presented in FIG. 2E. The waveguide feed ports 46 support the distribution of electromagnetic signals within the parallel waveguide structures formed by positioning the slotted plate 14 adjacent to and substantially along the face of the waveguide channel plate 12. For the embodiment shown in FIGS. 2A–2G, the connection of the slotted plate 14 to the waveguide channel plate 12 forms a parallel set of ridge waveguides, each having slots along the face of the slotted plate 14.

The waveguide channel plate 12 is preferably constructed from conductive material, such as aluminum stock. The waveguide channels 40, in combination with the slotted plate 14, preferably form ridge waveguide structures. The use of ridge waveguide is preferable for the antenna 10 based on the design requirement of closely-spaced waveguide slot radiators for simultaneous communication of dual polarized signals. This design objective for the exemplary embodiment of FIG. 1 can be satisfied by the relatively narrow waveguide structure of ridge waveguide.

For the representative embodiment shown in FIG. 2D, four pairs of subarrays, each subarray having six parallel waveguide channels 40, are stacked along the vertical axis of the waveguide channel plate 12. Each subarray includes a set of six feed ports 46. A subarray is essentially a complete single polarization antenna in itself. Each subarray has a low noise amplifier (LNA) attached to its single input port. The outputs of the LNA's for a selected polarization state are combined via coax cables and a 4:1 power combiner to obtain a single input port to the single polarization antenna.

The preferred antenna 10 comprises an interleaved pair of slotted arrays, a slant-right array and a slant-left array, each comprising six waveguide channels, for communicating electromagnetic signals having slant-right and slant-left polarization states. The slant-right array is offset by ½ element spacing along the direction of the ridge waveguide, relative to the slant-left array. This offset or staggering of arrays is necessary to prevent overlapping of the slant-right and slant-left bowtie-shaped cavity sections and to prevent overlapping of the slant-right and slant-left output slots. It is obvious from FIGS. 4A and 4B that collisions would occur if the interlaced arrays were not offset in this manner.

The preferred feed port 46 is implemented by a ridge waveguide-to-rectangular waveguide transition that imparts special reorientation of associated electric and magnetic fields. This transition is described in U.S. Pat. No. 4,673,946, entitled "Ridged Waveguide to Rectangular Waveguide Adapter Useful for Feeding Phased Array Antenna" and assigned to Electromagnetic Sciences, Inc. of Norcross, Ga., which is fully incorporated herein by reference. Generally described, the transition is effected via an electrically short non-resonant cavity using oppositely tapered continuations of the ridge waveguide walls to opposing walls of a rectangular waveguide port, which is spatially oriented transverse to the ridge waveguide. Oppositely tapered parallel plates are used to continue opposing ridge waveguide walls to connection points on opposite sides of a rectangular waveguide port on the opposite side of the non-resident cavity. The tapered plates operate as a two conductor balanced shielded transmission line while simultaneous serving to effect a ninety (90°) degree rotation of electric and magnetic field vectors.

Ridge dimensions and feed port spacings are respectively shown in FIGS. 2F and 2G. Referring first to FIG. 2F, a portion of the waveguide channel plate 12 is shown to illustrate the dimensions of the internal rectangular ridge 42 of the waveguide channel 40. Each waveguide channel 40 has a height of approximately 0.3 wavelengths and a width of approximately 0.38 wavelengths. Each internal rectangular ridge 42 has a height of approximately 0.2 wavelengths and a width of approximately 0.19 wavelength. Turning now to FIG. 2G, a preferred placement of the waveguide feed ports 46 is shown for a representative portion of the waveguide channels. The spacing of waveguide feed ports 46 positioned within the same waveguide channel 40 is approximately 0.75 wavelength. The approximate spacing between a waveguide feed port 46 of one of the waveguide channels 40 and the next closest feed port in an adjacent waveguide channel 40 is approximately 0.37 wavelength.

Figure 3A:
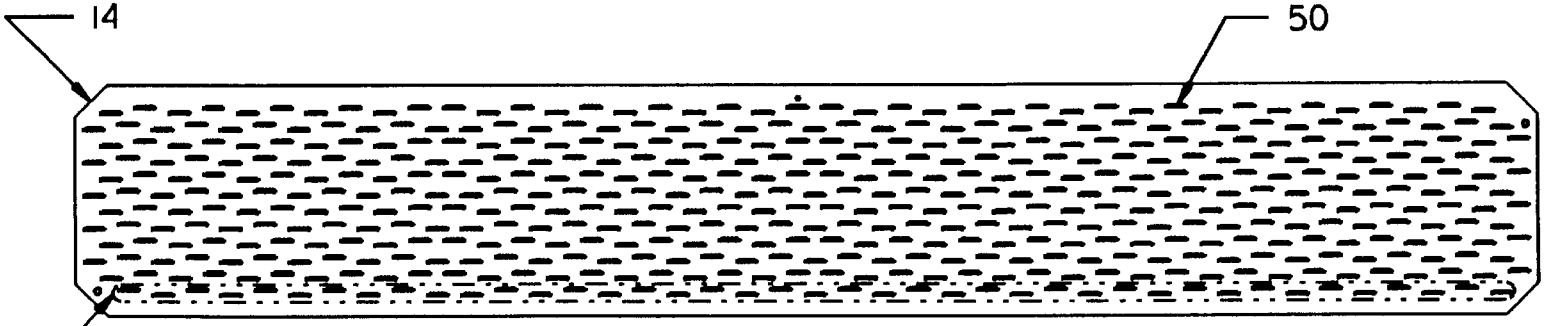
FIG. 3A is an illustration showing a top view of a plate comprising input slots in accordance with an exemplary embodiment of the present invention.
Figure 3B:
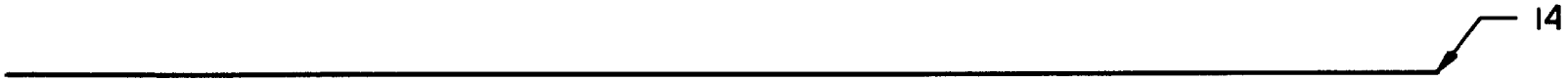
FIG. 3B is an illustration showing a side view of the plate presented in FIG. 3A.
Figure 3C:
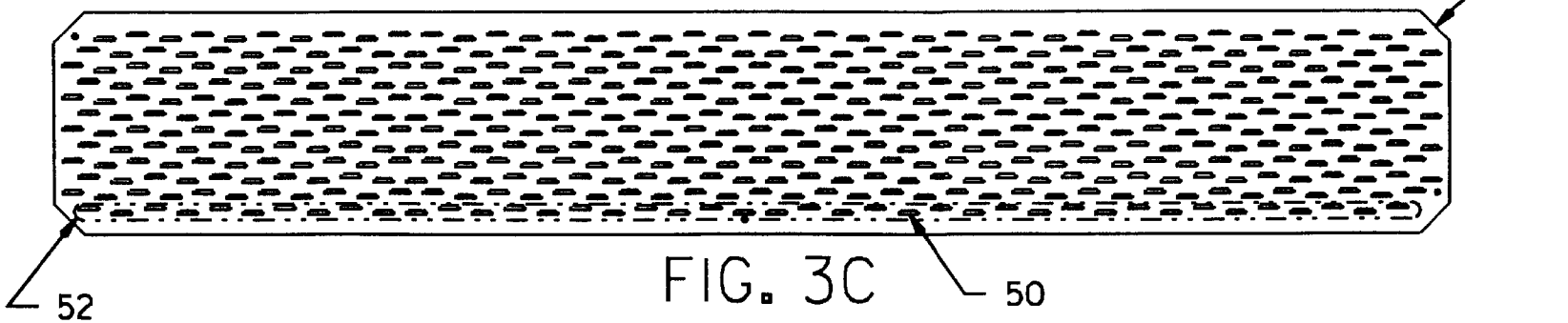
FIG. 3C is an illustration showing a rear view of the plate presented in FIG. 3A.

Referring now to FIG. 1 and FIGS. 3A–3C, collectively described as FIG. 3, the slotted plate 14 comprises a planar array of input slots 50 positioned along the face of the plate. The slotted plate 14 is mounted to the face of the waveguide channel plate 12 and extends substantially along the length and width of the plate 12. The slotted plate 14 preferably rests along the top edges of the side walls 44 of the waveguide channel plate 12. By covering the face of the waveguide channel plate 12 with the slotted plate 14, waveguide structures are formed to support the distribution of electromagnetic signals within the enclosed waveguide channels. Each waveguide structure comprises inputs slots 50 located on a front wall, which is provided by the slotted plate 14, and feed ports 46 positioned along a rear wall of the waveguide channel plate 12. For each waveguide structure, a waveguide channel is formed by a front wall and a rear wall with a rectangular ridge, which are separated by a pair of spaced-apart, parallel side walls. The preferred waveguide structure is ridge waveguide. Those skilled in the art will understand that other types of waveguide structures can be used for the antenna 10, including rectangular waveguide.

The input slots are preferably rectangular-shaped slots, each approximately 0.5 wavelengths long, cut into the slotted plate 14. Each input slot 50 is associated with only one of the waveguide structures formed by the combination of the waveguide channel plate 12 and the slotted plate 14. An input slot is preferably oriented parallel to the direction of propagation within its corresponding waveguide channel, thereby interrupting only transverse currents in the top wall of the waveguide channel. The input slots 50 are positioned along the slotted plate 14 in linear slot arrays 52 of shunt-type slots extending along the horizontal (propagation) axis of the waveguide channel. Specifically, each linear slot array 52 is aligned along the propagation axis of a waveguide channel 40 to accept electromagnetic signals distributed from this waveguide channel. The input slots 50 of each linear slot array 52 are offset from a central axis extending along the propagation axis of the corresponding waveguide channel 40.

For the representative embodiment shown in FIG. 3A, twelve parallel linear slot arrays 52 extend along the propagation axis of the waveguide channel plate 12. The slotted plate 14 is preferably constructed from a relatively thin conductive material, such as aluminum stock. The input slots 50 aligned along the propagation axis of a single waveguide channel 40 are spaced by approximately 0.75 wavelength. The spacing between input slots 50 of adjacent linear slot arrays 52 is approximately 0.38 wavelengths.

Figures 4A, 4B, 4C, 4D, 4E, 4F:
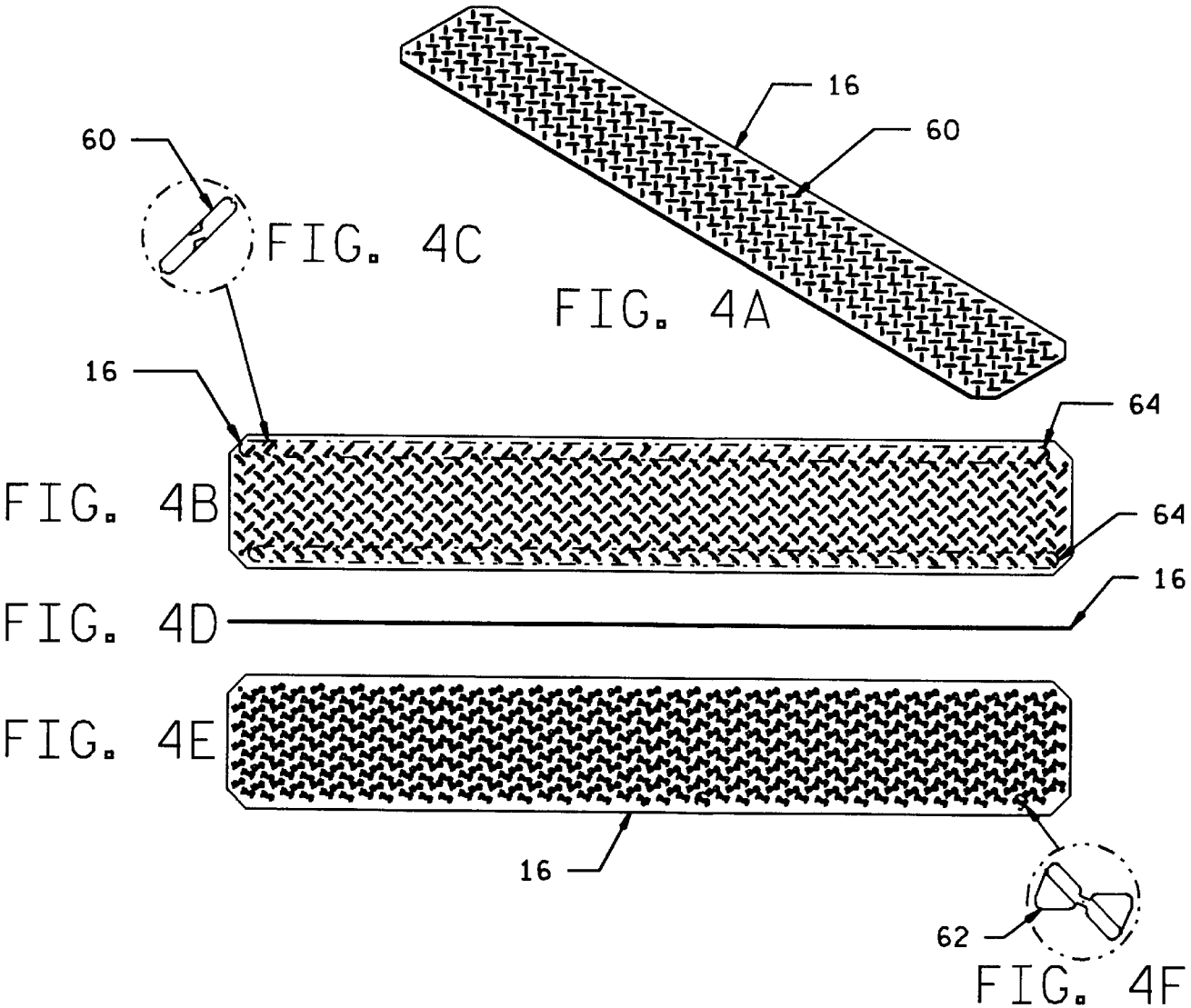
FIG. 4A is an illustration showing a front isometric view of a plate comprising output slots and cavity sections in accordance with an exemplary embodiment of the present invention.
FIG. 4B is an illustration showing a top view of the plate presented in FIG. 4A.
FIG. 4C is an illustration showing an enlarged view of an output slot along the front surface of the plate presented in FIG. 4A.
FIG. 4D is an illustration showing a side view of the plate presented in FIG. 4A.
FIG. 4E is an illustration showing a rear view of the plate presented in FIG. 4A.
FIG. 4F is an illustration showing an enlarged view of an output slot and a cavity along the rear surface of the plate presented in FIG. 4A.

Turning now to FIG. 1, FIGS. 3A–3C and FIGS. 4A–4F, respectively described in a collective manner as FIGS. 3 and 4, an array of cavity sections 62 and output slots 60 are respectively positioned along the rear and top surfaces of the plate 16. Each output slot 60 is associated with only one of the input slots 50 on the plate 14 and can be rotated in position relative to its corresponding input slot. An output slot is typically rotated with respect to its corresponding input slot to accommodate the electric field polarization which rotates as the electromagnetic signals pass between this pair of slots. As will be described in more detail below with respect to FIGS. 10A–10B, each cavity section 62 is positioned between slots 50 and 60 to form a waveguide slot radiator. The cavity sections 62 represent relatively thin transitional sections that separate the input slots 50 from the corresponding rotated output slots 60. The cavity sections 62 can be modeled as a transmission line for transmitting electromagnetic signals between the slots 50 and 60. The cavity sections 62 also support the matching of impedances presented by the input slots 50 and the corresponding output slots 60. Because the cavity sections 62 are preferably thin transitional sections, typically much less than one wavelength thick, the radiator plate 16 can be constructed from a relatively thin conductive material, such as aluminum plate. Indeed, each cavity section 62 has a thickness of preferably less than 0.1 wavelength.

The output slots 60 are positioned in linear slot arrays 64 that extend along the horizontal axis of the radiator plate 16. Each linear slot array 64 is aligned to accept electromagnetic signals passed from corresponding input slots 50 via the transitional transmission path provided by the cavity sections 62. Different rotation patterns are preferably used for adjacent linear slot arrays 64. In other words, linear slot arrays 64 having the same rotation pattern can be interleaved on an alternating basis with linear slot arrays 64 having a different rotation pattern. The alternating slot rotation patterns along the plate 16 support the communication of electromagnetic signals exhibiting dual polarization states.

For the representative embodiment shown in FIG. 1 and FIG. 4A, every other linear slot array 64 along the plate 16 includes output slots 60 rotated 45 degrees to the right of the corresponding input slots 50. The remaining linear slot arrays 64 include output slots 60 rotated 45 degrees to the left of the corresponding input slots 50. In this manner, signals having orthogonal polarization states can be communicated by a single aperture antenna. Specifically, two simultaneous radiation patterns of slant left and slant right polarization states can be supported by the antenna 10 shown in FIG. 1.

The cavity section 62 preferably has a "bow-tie"-shape because the cavity section assumes the form of a crossed pair of input and output slots 50 and 60. The length of the cavity section 62 is approximately 0.5 wavelength and its width is approximately 0.2 wavelength. The thickness of the cavity section 62 is preferably less than 0.1 wavelength.

Figures 5A, 5B:
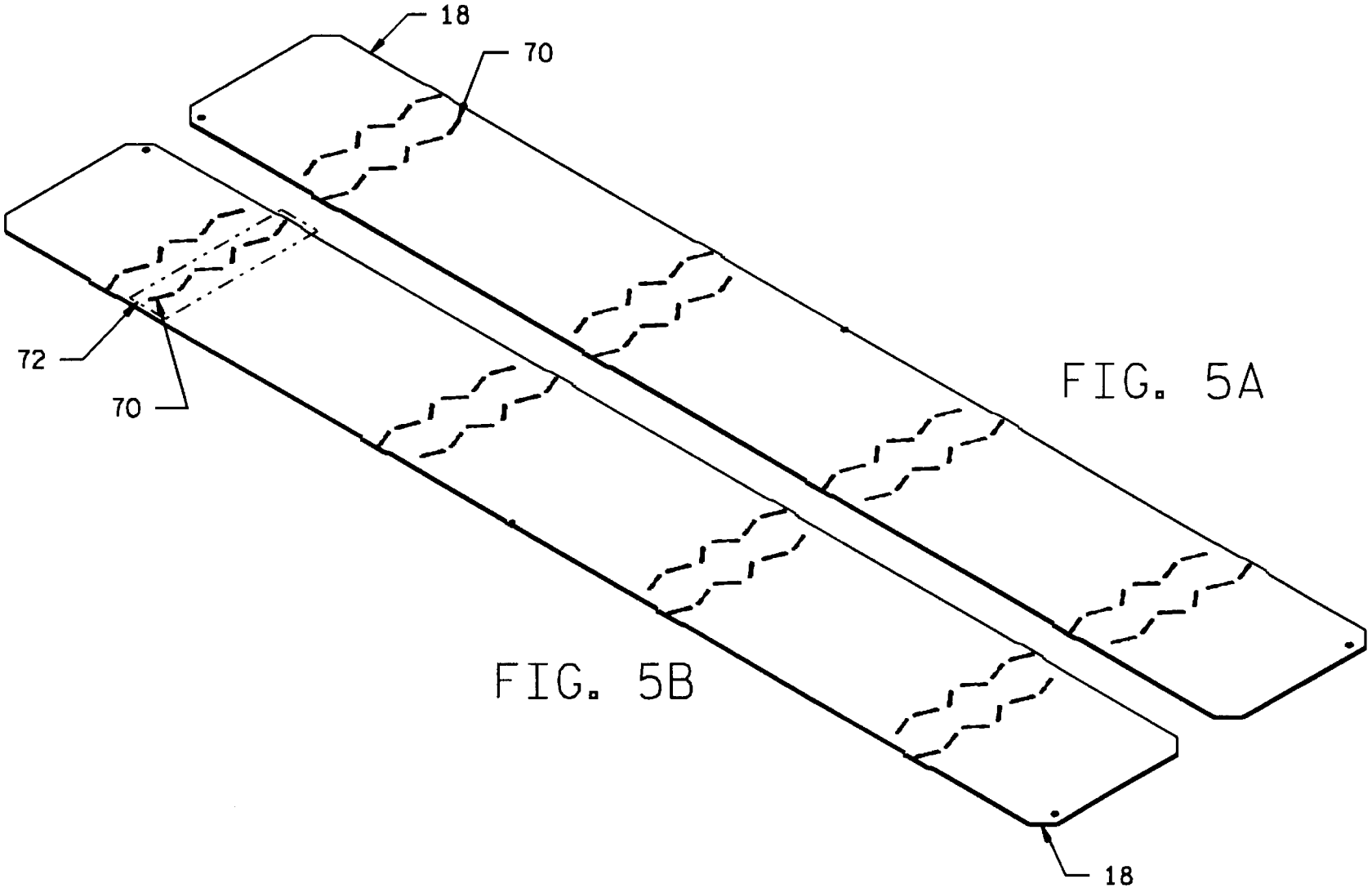
FIG. 5A is an illustration showing a front isometric view of a plate containing series slots for an antenna constructed in accordance with an exemplary embodiment of the present invention.
FIG. 5B is an illustration showing a rear isometric view of the plate presented in FIG. 5A.
Figures 6A, 6B, 6C:
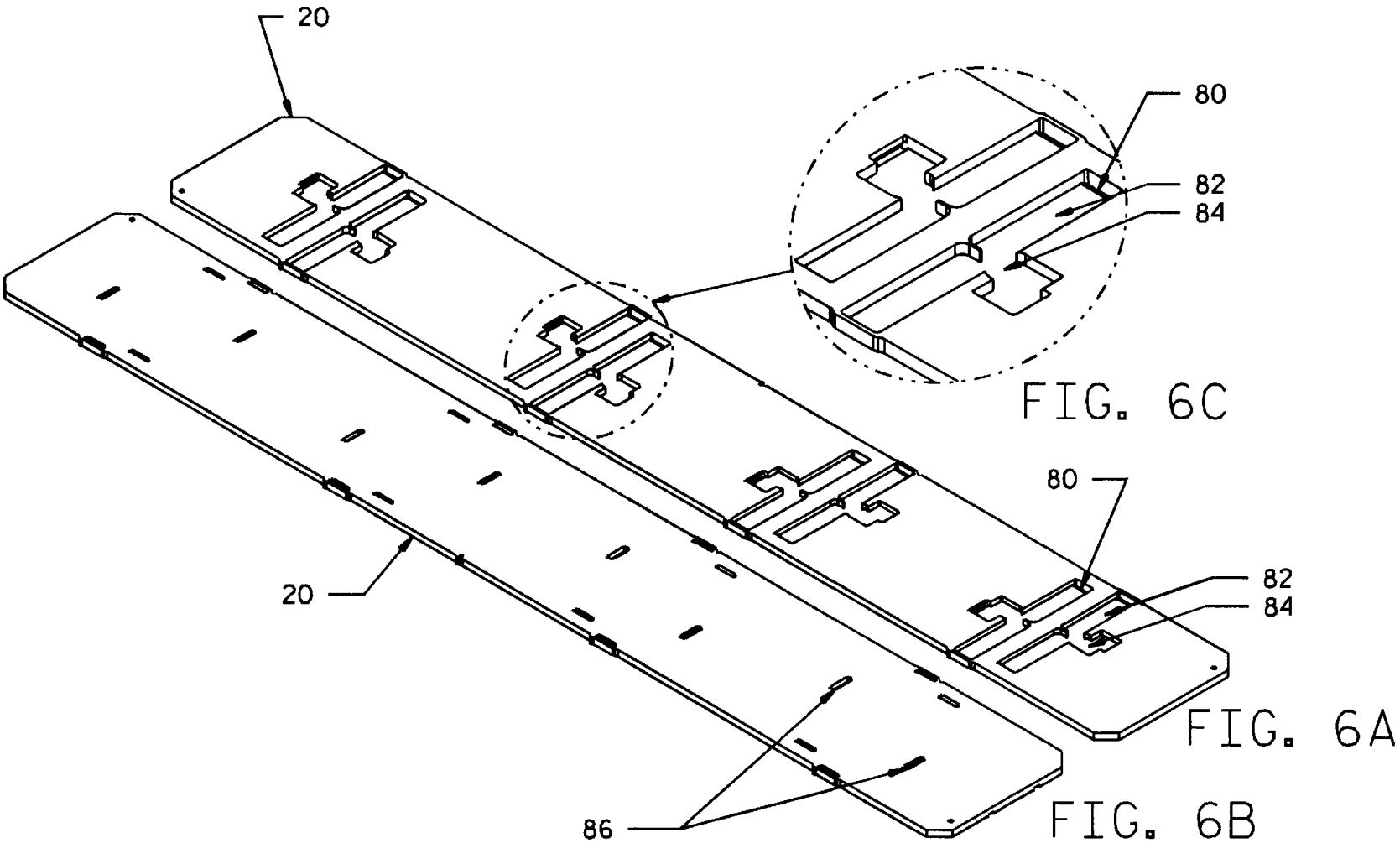
FIG. 6A is an illustration showing a front isometric view of a plate containing waveguide signal distribution channels for an antenna constructed in accordance with an exemplary embodiment of the present invention.
FIG. 6B is an illustration showing a rear isometric view of the plate presented in FIG. 6A.
FIG. 6C is an illustration showing an enlarged view of a waveguide signal distribution channel along the front surface of the plate presented in FIG. 6A.

FIG. 1, as well as FIGS. 5A–5B and FIGS. 6A–6C, respectively described in a collective manner as FIGS. 5 and 6, illustrate the primary components of the feed distribution network for the antenna 10. As best shown in FIGS. 5A–5B, the series slot plate 18 is positioned between the rear of the waveguide plate 12 and the face of the signal distribution plate 20. The series slot plate 18 comprises a plate of conductive material containing series-type slots 70 for exchanging electromagnetic signals with the feed ports 46 of the waveguide channel plate 12. Each series slot 70 is associated with a corresponding feed port 46 on the plate 12. Consequently, the series slots 70 are positioned along the series slot plate 18 to correspond to the placement of the feed ports 46 of the waveguide channel plate 12. For the illustrated exemplary embodiment, the series slot plate 18 comprises four pairs of series slot arrays 72, each array comprising six series slots 70.

As best shown in FIGS. 6A–6B, the signal distribution plate 20 is positioned between the rear of the series slot plate 18 and the subarray combining circuitry 24. The signal distribution plate 20 comprises conductive material and includes a front surface containing waveguide channels 82 and Tee junctions 84 and a rear surface containing input ports 86. A Tee junction 84 is positioned along the approximate center portion of a waveguide channel 82. For the illustrated exemplary embodiment, the signal distribution plate 20 comprises a conductive material, such as aluminum stock, and includes eight sets of waveguide channels 82 and Tee junctions 84 and eight corresponding input ports 86. Specifically input port 86 is aligned with the central portion of a corresponding waveguide channel 80 and proximate to the Tee junction 84. Each input port 86 can pass electromagnetic signals to and from subarray combining circuitry 24 shown in FIG. 1.

The series slot plate 18 is mounted to the face of the signal distribution plate 20 and extends substantially along the length and the width of the plate 20. Waveguide structures are formed by covering the face of the signal distribution plate 20 with the series slot plate 18. Specifically, the series slot plate 18 provides a conductive surface that covers each combination of a waveguide section 82 and a Tee junction 84 on the top surface of the signal distribution plate 20. These rectangular-shaped waveguide structures can distribute electromagnetic signals within the corresponding waveguide cavities and between the feed slots 86 and the series slots 70. Thus, a waveguide section 82 and a Tee junction 84, in combination with a corresponding series slot array 72, forms a distribution network for distributing electromagnetic signals to the corresponding set of feed ports 46.

Turning again to FIG. 1, the short circuit elements 22 operate as the end caps for the waveguide structures formed by the combination of the plates 18 and 20. For the exemplary embodiment shown in FIG. 1, eight pairs of short circuit elements 22 serve to extend the length of these waveguide structures and function as "folded short circuits." Each short circuit element 22 is positioned at one end of a waveguide section 82 and along the rear surface of the plate 20.

The subarray combining circuitry 24 comprises low noise amplifiers, cables and signal combiners for reducing the four subarrays of each orthogonal polarization to a single port for each polarization of the antenna 10.

A relatively thin layer of low dielectric constant material 26 is positioned along the face of the plate 16 and extends substantially along the length and the width of the plate. Similarly, a relatively thin layer of high dielectric constant material 28 is positioned adjacent to the low dielectric constant material 26 and extends substantially along the length and the width of this layer. This combination of the dielectric material 26 and 28 causes a decrease in resonant frequency and a decrease in shunt slot conductance, as viewed from the waveguide channels. These shifts, however, can be compensated by shortening the slot lengths and increasing the slot offsets from waveguide channel centerline. The use of the high dielectric constant material 28, spaced-apart from the slots 60 by the low dielectric constant material 26, results in an improvement of antenna bandwidth because the impedance match of the waveguide slot radiators is improved, as viewed from the free space side of the antenna 10.

The high dielectric constant material 28 is preferably a dielectric material marketed by Rogers Corporation under the model name "TMM-10". Other typical high dielectric constant materials suitable for use as a dielectric layer for the antenna 10 include a ceramic-loaded "TEFLON" material or an alumina-loaded "TEFLON" material. The preferred low dielectric constant material 26 is a low loss microwave foam material manufactured by RomeTech under the name "ROHACELL". The low dielectric constant material 26 is primarily used to physically separate the face of the radiator plate 16 from the layer of the high dielectric constant material 28. Consequently, there is a need to use a layer of low dielectric constant material having a physical support structure. The spacing of the high dielectric material off the antenna surface is a fixed number of less than 0.1 wavelengths.

A relatively thin layer of low dielectric constant material 30 is positioned along the face of the layer of high dielectric constant material 28 and extends substantially along the length and the width of this layer. Similarly, a polarizer 32 is positioned adjacent to the face of the low dielectric constant material 30 and extends substantially along the length and the width of the layer. The polarizer 32 operates to change the polarization of electromagnetic signals communicated by the antenna 10.

The preferred low dielectric constant material 30 is a low loss microwave foam material, such as the "ROHACELL" material distributed by RomeTech. Similar to the low dielectric constant material 26, the layer of low dielectric constant material 30 serves to separate the polarizer 32 from the face of the high dielectric constant material 28. The spacing of the polarizer 32 from the face of the high dielectric constant material 28 is a fixed number of approximately 0.2 wavelengths.

For the exemplary embodiment shown in FIG. 1, the polarizer 32 operates to transform the slant left and slant right polarization signals to left-hand and right-hand circular polarization signals. An alternative embodiment can use hybrid components within the subarray combining circuitry to achieve the desired conversion of polarization states. The total bandwidth of the antenna is approximately five (5%) percent. In contrast, the approximate bandwidth for a single waveguide slot radiator is ten (10%) percent in the absence of the remaining array slots.

Generally speaking, the combination of the input/output slots and the cavity section is useful for achieving the desired polarization characteristic of a communication signal. The cavity section supports a matching of the impedances presented by the input/output slots and rotates the electromagnetic field polarization from the polarization of the input slot to the polarization of the output slot.

FIGS. 7A–7B, FIGS. 8A–8B, FIGS. 9A–9B, FIGS. 10A–10B, FIGS. 11A–11B, and FIGS. 12A–12B illustrate a variety of waveguide slot radiator configurations formed by the placement of a cavity between input and output slots. To use the waveguide radiator in a linear resonant slotted array antenna, certain basic design requirements should be considered: (1) the sum of all normalized slot resonant conductances are nominally made to be equal to 2 for a center feed (or 1 for an end feed), and (2) the radiated power from each slot location is proportional to that slot's resonant conductance. In the preferred embodiment of the antenna 10, the slots are designed to radiate equal power, so the resonant conductance of all slots is designed to be equal. Consequently, an equivalent circuit for this antenna design can be modeled by a transmission line with short circuits at each end and equally spaced shunt admitances at each shunt slot location. This transmission line as viewed from its feed point, loads the series resistance which represents the series feed slot. The feed section of the antenna is modeled by a transmission line with loaded series impedances at each series slot location. The values of the shunt conductances are generally controlled by the distance that the slots are offset from the center of the waveguide. The length of each slot determines the point of resonance, i.e., pure conductive component for a selected frequency. The waveguide slot radiator formed by the placement of a cavity section between input and output slots should present an equivalent circuit shunt conductance that is similar to a typical broad wall shunt slot radiator. This is accomplished by designing a cavity section that matches the discontinuities at the input slot-to-cavity interface and the cavity-to-output slot interface.

Figures 7A, 7B:
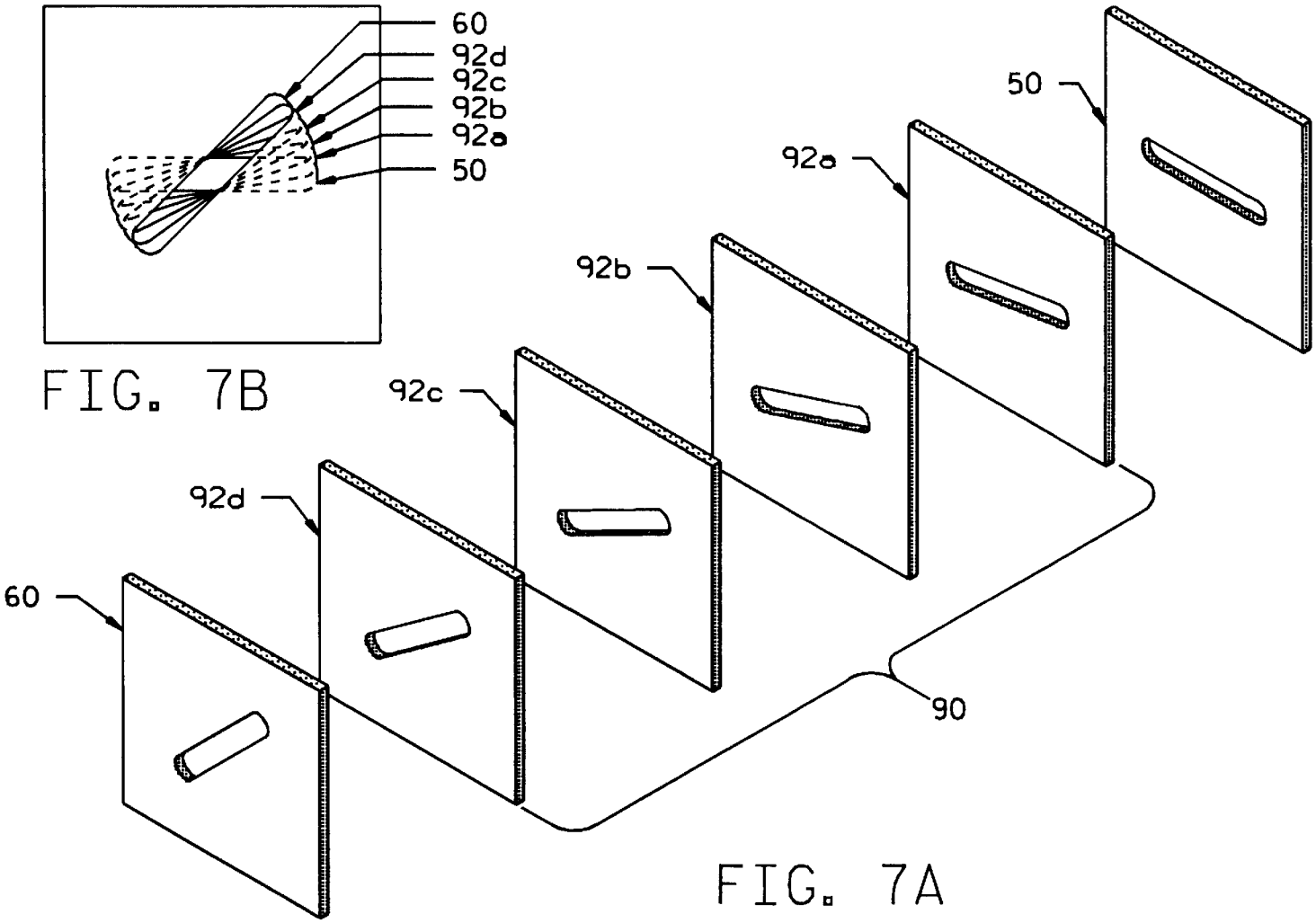
FIG. 7A is an illustration showing sections of a waveguide slot radiator constructed in accordance with an alternative exemplary embodiment of the present invention.
FIG. 7B is an illustration showing an assembled view of the waveguide slot radiator presented in FIG. 7A.

Placing a simple rectangular-shaped cavity between the input and output slots provides a poor match due to the large physical discontinuities formed at the interfaces. One possible solution is to build a cavity section 90 having multiple rectangular slot-shaped sections 92*a*, 92*b*, 92*c* and 92*d*, each having a uniform waveguide cross section and slightly rotated in position, as shown in FIGS. 7A–7B. This combination of rotated sections results in a cavity section that twists in a winding "stair-step" fashion between the rectangular-shaped input slot 50 and output slot 60, as best shown in FIG. 7B. The individual sections are relatively thin, resulting in an overall cavity section 90 having a thickness much less than one wavelength. Analysis results, however, suggest that this method of field rotation over very short distances does not provide an optimal impedance match between the input slot and the output slot.

Figures 8A, 8B:
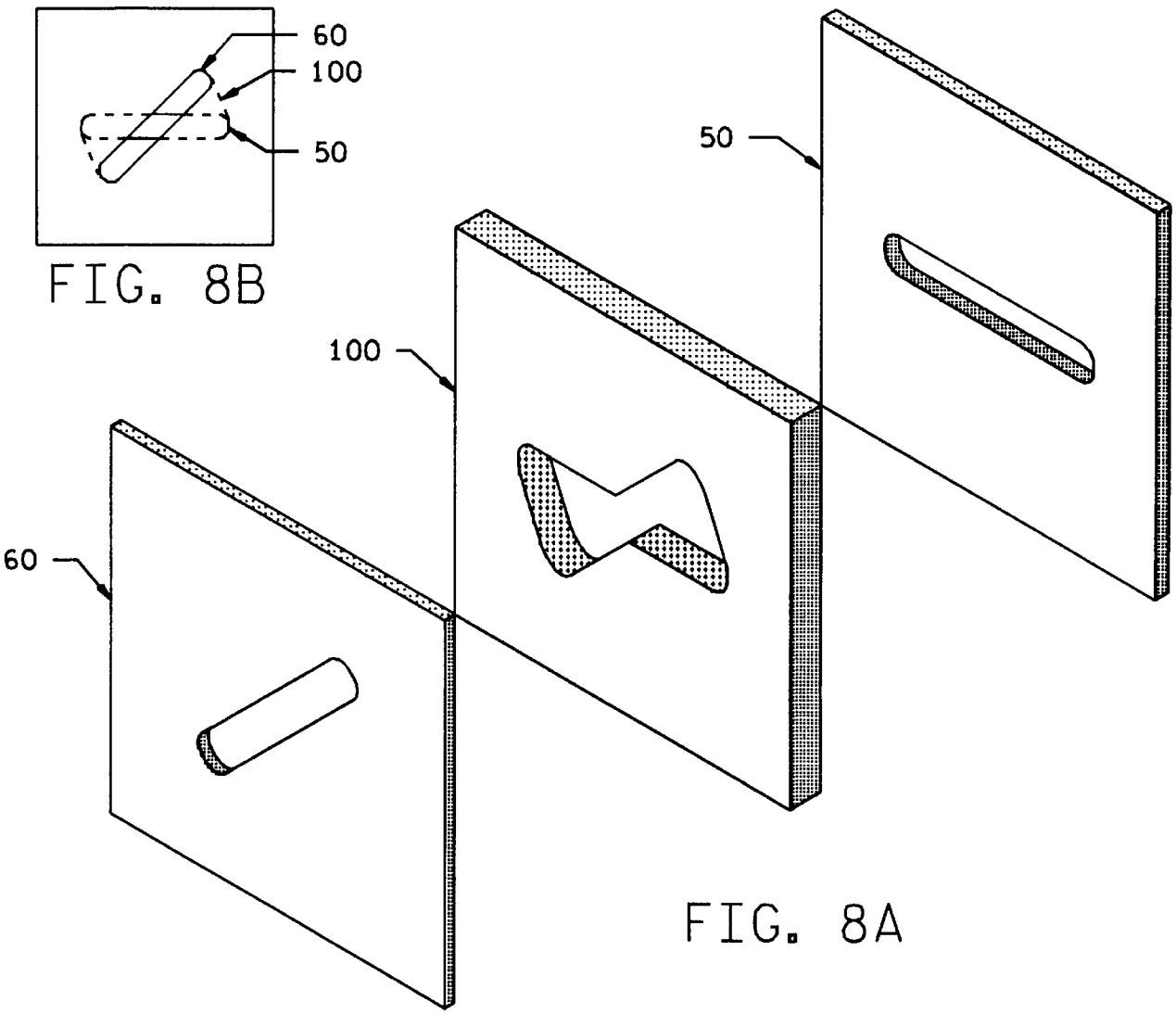
FIG. 8A is an illustration showing sections of a waveguide slot radiator constructed in accordance with an alternative exemplary embodiment of the present invention.
FIG. 8B is an illustration showing an assembled view of the waveguide slot radiator presented in FIG. 8A.

A more desirable impedance match result can be accomplished by reducing the broad walls of a rectangular-shaped cavity section 100, as shown in FIGS. 8A–8B. For this embodiment, the central portion of each broad wall of the cavity section 100 is angled inwardly to form a point at the approximate center of the section. The intersections of the broad walls and the narrow walls of the cavity section 100 form angles less than 90 degrees. By "squeezing" its broad walls, the cavity section changes from an original rectangular shape to a bow-tie shape, thereby forming a uniform ridge waveguide section. The reduction of the cavity's broad wall reduces the physical discontinuity between the slots 50 and 60 and the cavity section 100 within the central, high field region of the slots, thus improving the match. The cavity section 100 preferably has an approximate thickness of much less than one wavelength. For the embodiment shown in FIGS. 8A–8B, the rectangular-shaped output slot 60 is rotated 45 degrees from the rectangular-shaped input slot 50. The slots 50 and 60, which are separated by the relatively thin cavity section 100, overlap at the center portions of the slots, thereby forming an X-shaped set of rectangular-shaped slots.

Figures 9A, 9B:
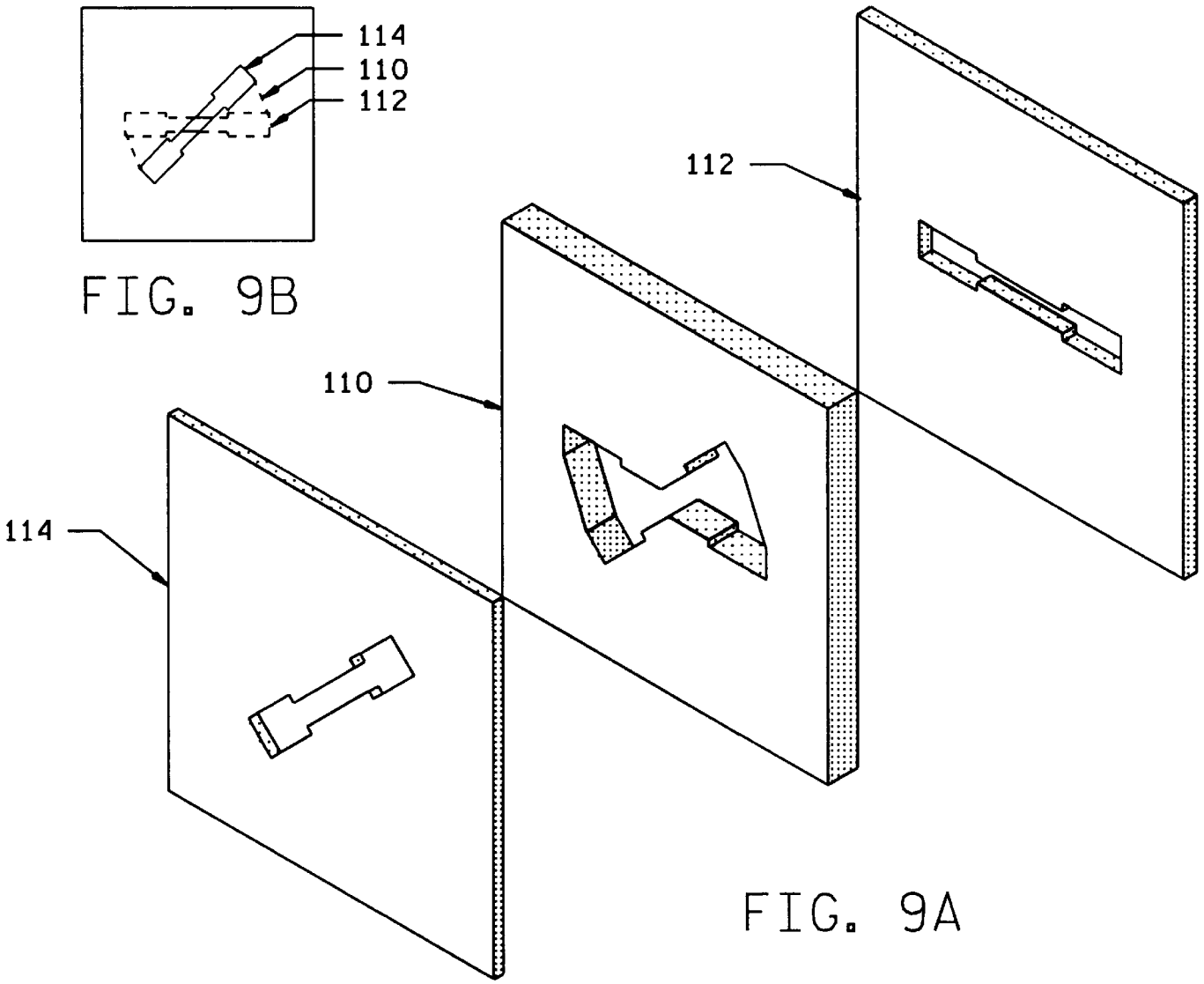
FIG. 9A is an illustration showing sections of a waveguide slot radiator constructed in accordance with an alternative exemplary embodiment of the present invention.
FIG. 9B is an illustration showing an assembled view of the waveguide slot radiator presented in FIG. 9A.

An alternative method of improving the match between input and output slots is to constrict the central regions of both the input and output slots and the cavity section, as shown in FIGS. 9A–9B. The broad walls of a cavity section 110 slant inwardly to form a point at the approximate center of each wall. In addition, the intersections of the broad walls and the narrow walls of the cavity section 110 form angles less than 90 degrees. The cavity section 110 preferably has an approximate thickness of much less than a wavelength, typically less than 0.1 wavelengths. For most applications, the approximate thickness of the cavity section 110 can be between 0.03 and 0.2 wavelengths. Similar to the broad walls of the cavity section 110, the width of an input slot 112 and a rotated output slot 114 narrows at the approximate center portion of these slots. For the embodiment shown in FIGS. 9A–9B, the output slot 114 is rotated 45 degrees from the input slot 112. The slots 112 and 114, which are separated by the relatively thin cavity section 110, overlap at the center portions of the slots, thereby forming an X-shaped set of slots.

Figures 10A, 10B:
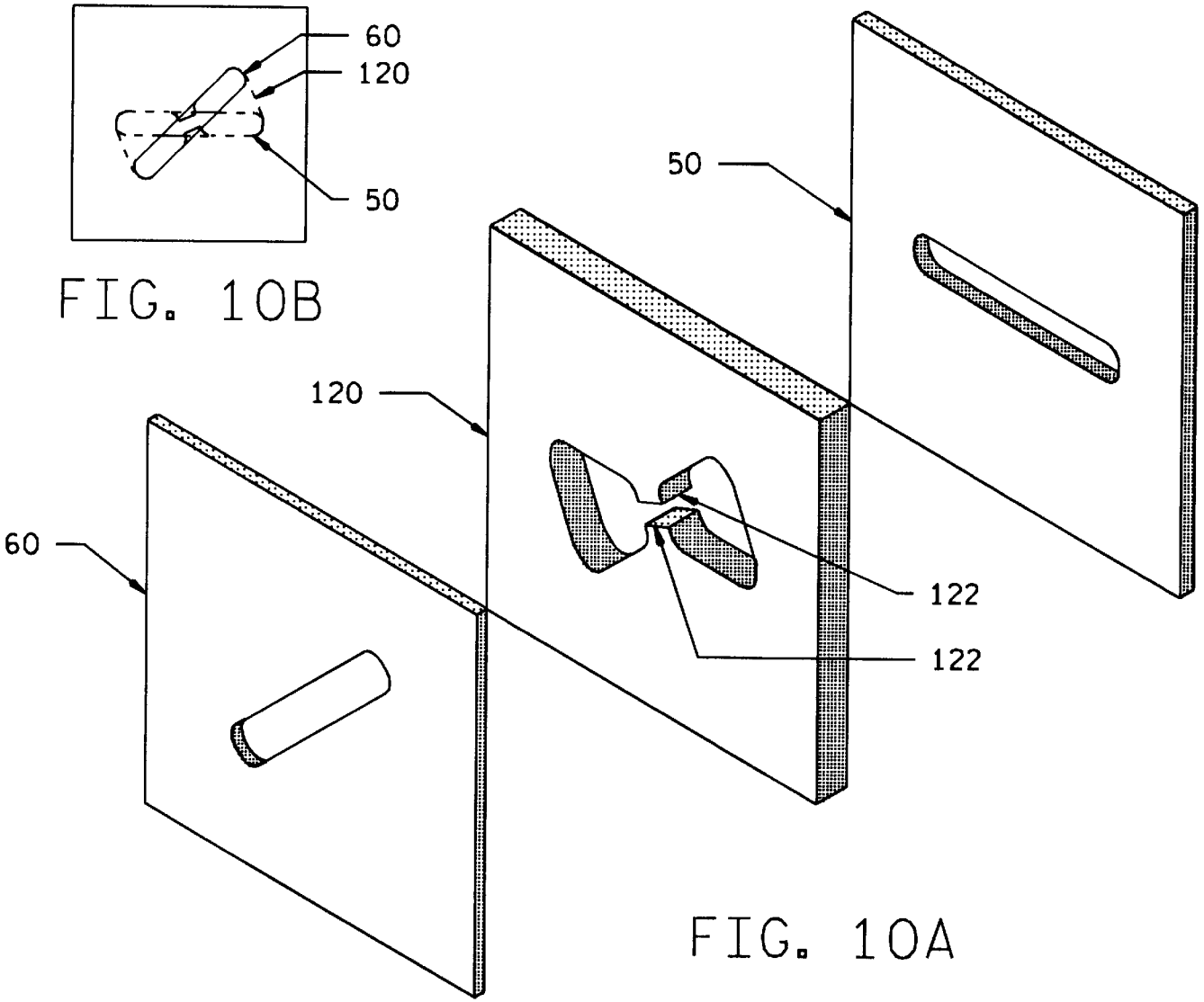
FIG. 10A is an illustration showing sections of a waveguide slot radiator constructed in accordance with an exemplary embodiment of the present invention.
FIG. 10B is an illustration showing an assembled view of the waveguide slot radiator presented in FIG. 10A.

Another alternative method of improving the match between input and output slots is to constrict the central region of the cavity section, as shown in FIGS. 10A–10B. The embodiment shown in FIGS. 10A–10B is the technique shown in the exemplary antenna 10 illustrated in FIG. 1. The central portion of each broad wall of the cavity section 120 is angled inwardly to form a stub 122 at the approximate center of the section. A gap separates the stubs 122 located on the opposite broad walls. The intersections of the broad walls and the narrow walls of the cavity section 120 form angles less than 90 degrees. In contrast, the broad walls of the rectangular-shaped input and output slots 50 and 60 remain flat. The cavity section 120 preferably has a thickness much less than a wavelength, typically less than 0.1 wavelengths. For most applications, the approximate thickness of the cavity section 120 can be between 0.03 and 0.2 wavelengths. For the embodiment shown in FIGS. 10A–10B, the rectangular-shaped output slot 60 is rotated 45 degrees from the rectangular-shaped input slot 50. The slots 50 and 60, which are separated by the relatively thin cavity section 120, overlap at the center portions of the slots, thereby forming an X-shaped set of rectangular-shaped slots.

Figures 11A, 11B:
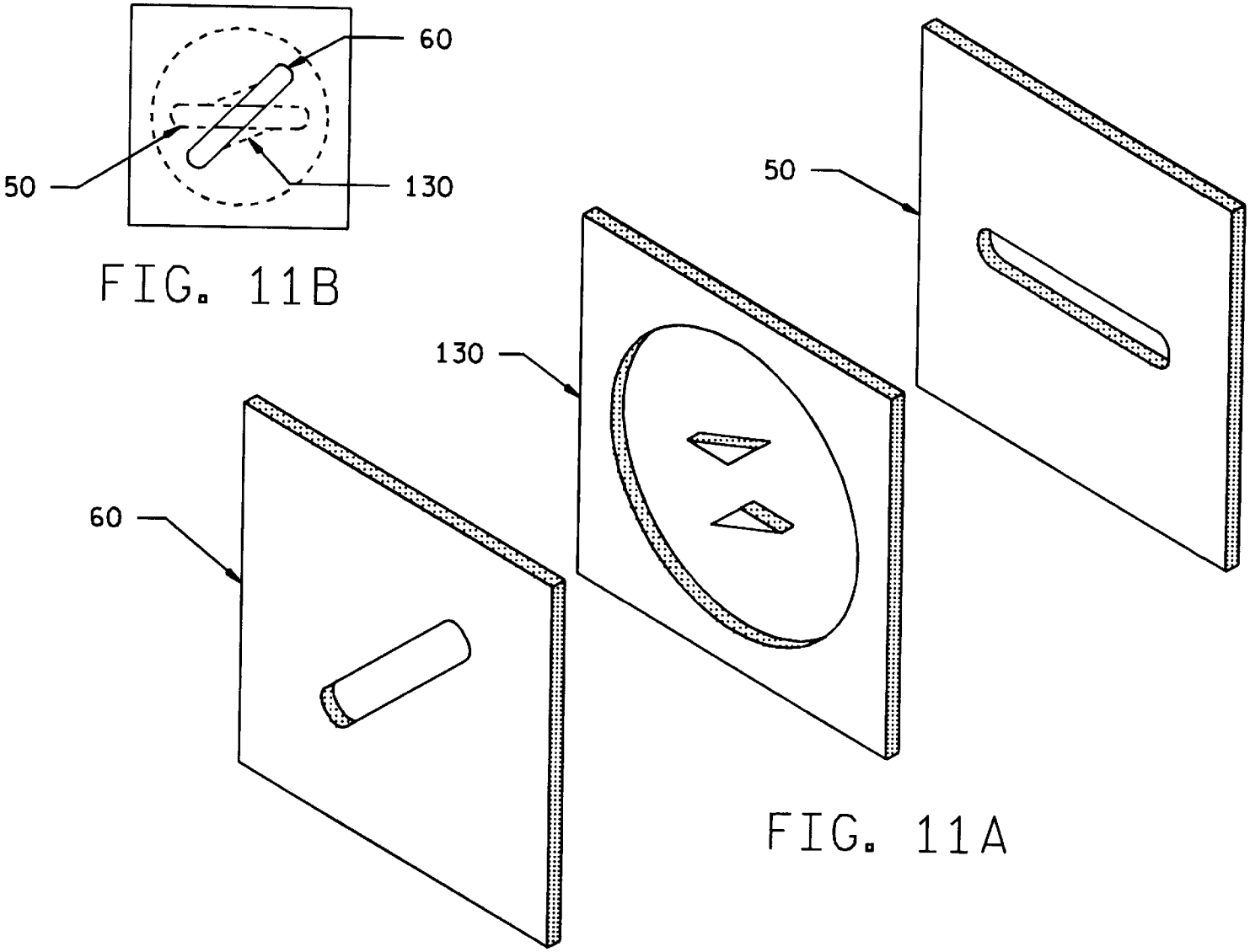
FIG. 11A is an illustration showing sections of a waveguide slot radiator constructed in accordance with an alternative exemplary embodiment of the present invention.
FIG. 11B is an illustration showing an assembled view of the waveguide slot radiator presented in FIG. 11A.
Figures 12A, 12B:
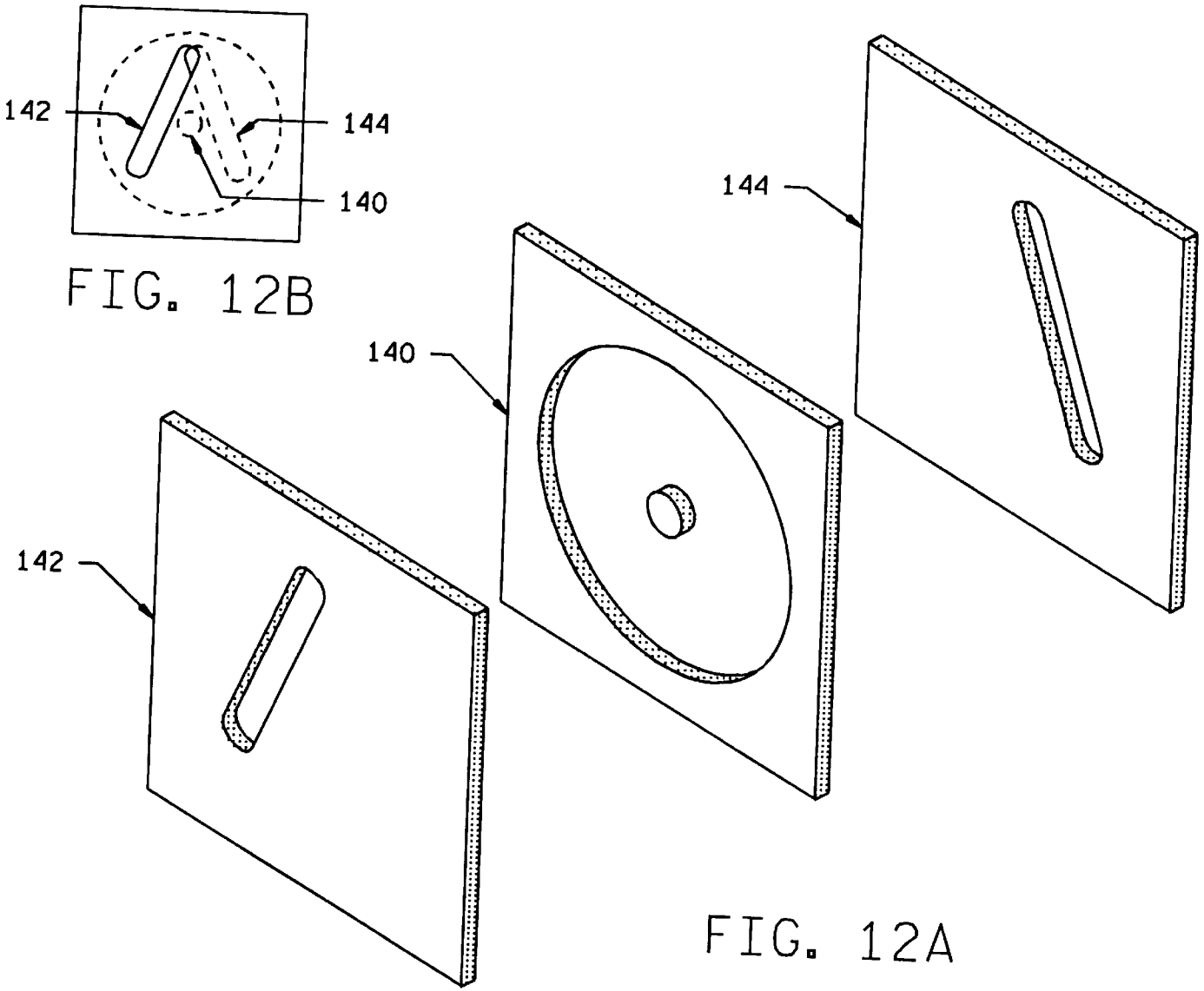
FIG. 12A is an illustration showing sections of a waveguide slot radiator constructed in accordance with an alternative exemplary embodiment of the present invention.
FIG. 12B is an illustration showing an assembled view of the waveguide slot radiator presented in FIG. 12A.

The waveguide slot radiator, which comprises an input slot, a cavity section and an output slot, can also be designed and modeled as a transition from TE mode-to-TEM mode-to-TE mode. For example, the cavity section can be modeled as a short section of TEM transmission line for a slant polarized, shunt slot radiator. Thus, a cavity section 130 can be implemented as a twin lead TEM structure, as shown in FIGS. 11A-–11B. Alternatively, a cavity section 140 can be implemented as a coaxial-like TEM structure, as shown in FIGS. 12A–12B.

For the embodiment shown in FIGS. 11A–11B, the rectangular-shaped output slot 60 is rotated 45 degrees from the rectangular-shaped input slot 50. The slots 50 and 60, which are separated by the cavity section 130, overlap at the center portions of the slots, thereby forming an X-shaped set of rectangular-shaped slots. In contrast, for the embodiment shown in FIGS. 12A–12B, an output slot 142 overlaps an input slot 144 at one end of the slots, thereby forming a V-shaped set of rectangular-shaped slots.

The inventors have established the feasibility of using the improved waveguide slot radiator within a slotted array antenna designed by conducting a combination of analysis techniques. Finite element analysis, using Ansoft's "Eminence" and Hewlett Packard's "High Frequency Structure Simulator" programs, provides scattering parameters for the waveguide slot radiator's connection into the broadwall of the ridge waveguide channel. Finite element analysis or moment method codes provide the scattering parameters for the output slot's interface with the active array environment. Finite element analysis also provides scattering parameters for the series-series coupling from the feed distribution waveguide to the ridge waveguide channels. Connection of proper combinations of these scattering matrices provides a model of an entire antenna array. The inventive concepts described herein also have been proven by the fabrication and measurement of prototype subarrays and complete exemplary antennas, as shown in FIG. 1.

While the present invention is susceptible to various modifications and alternative forms, a preferred embodiment has been depicted by way of example in the drawings and will be further described in detail. It should be understood, however, that it is not intended to limit the scope of the present invention to the particular embodiments described. On the contrary, the intention is to cover all modifications, equivalents, and alternatives falling within the spirit and scope of the invention as defined by the appended claims.

What is claimed is:

1. A waveguide slot radiator, comprising:

an input slot for communicating electromagnetic signals;

an output slot for communicating electromagnetic signals;

a cavity section comprising a cavity, a first opening positioned adjacent to the input slot and a second opening positioned adjacent to the output slot, the cavity connecting the first opening and the second opening and operative to rotate the electromagnetic field polarization of electromagnetic signals from a first polarization state to a second polarization state.

2. The waveguide slot radiator of claim 1, wherein the cavity section is operative to provide an impedance match for efficient transmission of the electromagnetic signals from the input slot to the output slot.

3. The waveguide slot radiator of claim 1, wherein the cavity section is operative to rotate the electromagnetic field polarization from (to) the dominant mode polarization of the input slot to (from) the dominant mode polarization of the output slot.

4. The waveguide slot radiator of claim 1, wherein the input slot comprises a slot positioned along the broadwall of a waveguide, and the first opening of the cavity section is aligned with the input slot and is operative to pass electromagnetic signals between the cavity section and the slot.

5. The waveguide slot radiator of claim 1, wherein the input slot comprises a slot positioned along the narrow wall of a waveguide, and the first opening of the cavity section is aligned with the slot and is operative to pass electromagnetic signals between the cavity section and the slot.

6. The waveguide slot radiator of claim 1, wherein the output slot comprises a slot rotated relative to the position of the input slot, and the second opening of the cavity section is aligned with the rotated slot and is operative to pass electromagnetic signals between the rotated slot and the cavity section.

7. The waveguide radiator of claim 1, wherein the cavity section has a thickness of less than a wavelength.

8. The waveguide radiator of claim 1 further comprising dielectric material positioned adjacent to the output slot and opposite the second opening of the cavity section, the dielectric material operative to improve an impedance match between the input slot and the output slot, as viewed from the free space side of the waveguide radiator.

9. The waveguide radiator of claim 8, wherein the dielectric material comprises a first dielectric layer having a high dielectric constant positioned adjacent to a second dielectric layer having a low dielectric constant, the second dielectric layer located adjacent to the output slot and opposite the second opening of the cavity.

10. The waveguide radiator of claim 1, wherein the cavity section comprises a uniform waveguide section having a length of less than a wavelength in the propagation direction, the first opening is aligned with the input slot, and the second opening is aligned with the output slot.

11. The waveguide radiator of claim 10 wherein the uniform waveguide section comprises a rectangular cross section having a pair of broad walls.

12. The waveguide radiator of claim 11 wherein the broad walls are constricted at a central position along each wall to create a cavity having a bowtie-shaped cross section.

13. The waveguide radiator of claim 10, wherein the input and the output slots comprise a ridge waveguide cross section.

14. The waveguide radiator of claim 1, wherein the cavity section comprises a section of TEM transmission line having a dimension of less than a wavelength in the propagation direction, the first opening is aligned with the input slot, and the second opening is aligned with the output slot.

15. The waveguide radiator of claim 14, wherein the TEM transmission line comprises a center conductor in a coaxial configuration.

16. The waveguide radiator of claim 14, wherein the TEM transmission line comprise a pair of conductors in a shielded twin lead configuration.

17. The method of claim 1, wherein the input slot is not parallel to the output slot.

18. A waveguide-implemented antenna, comprising:

a plurality of parallel waveguide structures, each comprising a waveguide defined by rear wall, a pair of side walls connected to the rear wall, and a front wall connected to the side walls and comprising a plurality of input slots for communicating electromagnetic signals;

a conductive plate, positioned substantially adjacent and parallel to the front wall, comprising a plurality of cavity sections aligned with the input slots and a plurality of output slots for communicating electromagnetic signals, each cavity section comprising a cavity, a first opening and a second opening, the first opening positioned adjacent to one of the input slots and operative to pass the electromagnetic signals between the adjacent input slot and the cavity, the second opening positioned adjacent to one of the output slots and operative to pass the electromagnetic signals between the adjacent output slot and the cavity, the cavity connecting the first opening and the second opening and operative to rotate the electromagnetic field polarization of electromagnetic signals from a first polarization state to a second polarization state.

19. The antenna of claim 18, wherein each cavity section is operative to provide an impedance match for efficient transmission of the electromagnetic signals between the input slot and the output slot, and wherein each cavity section is operative to rotate the polarization of the electromagnetic field from (to) the dominant mode polarization of the input slot to (from) the dominant mode polarization of the output slot.

20. The antenna of claim 18, wherein the front wall of each waveguide structure comprises a broadwall, and each input slot comprises a slot positioned along the broadwall and is aligned with the first opening of one of the cavity sections.

21. The antenna of claim 18, wherein the front wall of each waveguide structure comprises a narrow wall, and each input slot comprises a slot positioned along the narrow wall and is aligned with the first opening of one of the cavity sections.

22. The antenna of claim 18, wherein each output slot comprises a slot rotated relative to the position of one of the input slots and is aligned with the second opening of the cavity section.

23. The antenna of claim 18 further comprising dielectric material positioned along the conductive plate and adjacent to the output slots, the dielectric material operative to improve impedance matching between the input slots and the output slots, as viewed from the free space side of the antenna, the dielectric material comprising a first dielectric layer having a high dielectric constant positioned adjacent to a second dielectric constant layer having a low dielectric constant, the second dielectric layer located adjacent to the output slots.

24. The antenna of claim 18, wherein the cavity section comprises a uniform waveguide section having a length of less than a wavelength in the propagation direction, the first opening is aligned with one of the input slots, and the second opening is aligned with one of the output slots.

25. The antenna of claim 24, wherein the uniform waveguide section comprises a rectangular waveguide cross section having a pair of broad walls constricted at a central position along each wall to create a cavity having a bowtie-shaped cross section.

26. The antenna of claim 18, wherein the cavity section comprises a section of TEM transmission line having a length of less than a wavelength in the propagation direction, the first opening is aligned with one of the input slots, and the second opening is aligned with one of the output slots.

27. The antenna of claim 26, wherein the TEM transmission line comprises a center conductor in a coaxial configuration.

28. The antenna of claim 26, wherein the TEM transmission line comprises a pair of conductors in a shielded twin lead configuration.

29. The antenna of claim 18 further comprising a waveguide-implemented single aperture comprising a first one of the antenna and second one of the antenna, the first antenna interlaced with the second antenna, the first antenna having its output slots rotated +45 degrees from its input slots, and the second antenna having its output slots rotated −45 degrees from its input slots, whereby the first and second antennas communicate electromagnetic signals having a pair of simultaneous orthogonal polarization states.

30. The antenna of claim 29, wherein the first and second antennas operate within the same band of frequencies.

31. The antenna of claim 29, wherein the first and second antennas operate in separate bands of frequencies.

32. A waveguide-implemented single aperture antenna comprising two independent, interlaced antennas of claim 18, the first antenna having its output slots rotated with respect to its input slots, and the second antenna having its output slots rotated with respect to its input slots, whereby the two independent antennas communicate electromagnetic signals having a pair of simultaneous arbitrary polarization states.

33. The antenna of claim 32, wherein the first and second antennas operate within the same band of frequencies.

34. The antenna of claim 32, wherein the first and second antennas operate in separate bands of frequencies.

35. The method of claim 18, wherein one of the input slots is not parallel to one of the output slots.

36. A waveguide-implemented antenna, comprising:

a planar array of waveguide slot radiators, each radiator comprising:

an input slot for communicating electromagnetic signals;

an output slot for communicating electromagnetic signals; and a cavity section comprising a cavity, a first opening positioned adjacent to and aligned with the input slot and a second opening positioned adjacent to and aligned with the output slot, the cavity connecting the first opening and the second opening and operative to to provide an impedance match for efficient transmission of the electromagnetic signals between the input slot and the output slot and to rotate the electromagnetic field polarization of electromagnetic signals from a first polarization state to a second polarization state.

37. The waveguide-implemented antenna of claim 36 further comprising a plurality of parallel waveguide structures, each comprising (1) a waveguide defined by a rear wall, (2) a pair of side walls connected to the rear wall, (3) a front wall connected to the side walls and including the planar array of waveguide slot radiators.

38. The waveguide-implemented antenna of claim 37 further comprising a short circuit positioned at each end of the waveguide, the short circuit connected to the rear wall, the front wall, and the side walls of the waveguide.

39. The antenna of claim 37, wherein the front wall comprises a broadwall of the waveguide, and each input slot comprises a slot positioned along the broadwall and is aligned with the first opening of one of the cavity sections.

40. The antenna of claim 37, wherein the front wall comprises a narrow wall of the waveguide, and each input slot comprises a slot positioned along the narrow wall and is aligned with the first opening of one of the cavity sections.

41. The antenna of claim 36, wherein each output slot comprises a slot rotated relative to the position of one of the input slots and is aligned with the second opening of the cavity section.

42. The antenna of claim 36 further comprising dielectric material operative to improve impedance matching between the input slots and the output slots, as viewed from the free space side of the antenna, the dielectric material comprising a first dielectric layer having a high dielectric constant positioned adjacent to a second dielectric constant layer having a low dielectric constant, the second dielectric layer located adjacent to the output slots and along the front wall.

43. The antenna of claim 36, wherein the cavity section comprises a waveguide section having a rectangular waveguide cross section comprising a pair of broad walls constricted at a central position along each wall.

44. The method of claim 36, wherein the input slot is not parallel to the output slot.

45. A waveguide-implemented antenna, comprising:

a single antenna aperture comprising a first antenna interlaced with a second antenna, the first antenna independent from the second antenna, the first antenna comprising a planar array of waveguide slot radiators, each radiator comprising:

a first input slot for communicating electromagnetic signals;

a first output slot for communicating electromagnetic signals; and a first cavity section comprising a cavity, a first opening positioned adjacent to and aligned with the input slot and a second opening positioned adjacent to and aligned with the output slot, the cavity connecting the first opening and the second opening and operative to to provide an impedance match for efficient transmission of the electromagnetic signals between the input slot and the output slot and to rotate the electromagnetic field polarization of electromagnetic signals from a first polarization state to a second polarization state;

the second antenna comprising a planar array of waveguide slot radiators, each radiator comprising:

a second input slot for communicating electromagnetic signals;

a second output slot for communicating electromagnetic signals; and a second cavity section comprising a cavity, a first opening positioned adjacent to and aligned with the input slot and a second opening positioned adjacent to and aligned with the output slot, the cavity connecting the first opening and the second opening and operative to to provide an impedance match for efficient transmission of the electromagnetic signals between the input slot and the output slot and to rotate the electromagnetic field polarization of electromagnetic signals from a first polarization state to a second polarization state.

46. The antenna of claim 45, wherein the first output slots of the first antenna are rotated from the first input slots of the first antenna, and the second output slots of the second antenna are rotated from the second input slots of the second antenna, whereby the first and second antennas communicate electromagnetic signals having a pair of simultaneous orthogonal polarization states.

47. The antenna of claim 45, wherein the first and second antennas operate within the same band of frequencies.

48. The antenna of claim 45, wherein the first and second antennas operate in separate bands of frequencies.

49. The method of claim 45, wherein the input slot is not parallel to the output slot.

* * * * *